US007922968B2

(12) United States Patent
Son et al.

(10) Patent No.: US 7,922,968 B2
(45) Date of Patent: Apr. 12, 2011

(54) CORROSION RESISTANCE IMPROVED STEEL SHEET FOR AUTOMOTIVE MUFFLER AND METHOD OF PRODUCING THE STEEL SHEET

(75) Inventors: Won-Ho Son, Kyungsangbukdo (KR); Jai-Ik Kim, Kyungsangbukdo (KR); Seung-Hee Lee, Seongnam-shi (KR); Jeong-Bong Yoon, Kyungsangbukdo (KR); Hee-Man Son, Euijeongbu-shi (KR)

(73) Assignee: Posco, Kyungsangbuk-Do (KR)

( * ) Notice: Subject to any disclaimer, the term of this patent is extended or adjusted under 35 U.S.C. 154(b) by 414 days.

(21) Appl. No.: 12/089,757

(22) PCT Filed: Oct. 25, 2006

(86) PCT No.: PCT/KR2006/004374

§ 371 (c)(1),
(2), (4) Date: Apr. 10, 2008

(87) PCT Pub. No.: WO2007/049915

PCT Pub. Date: May 3, 2007

(65) Prior Publication Data

US 2008/0257461 A1 Oct. 23, 2008

(30) Foreign Application Priority Data

| | | |
|---|---|---|
| Oct. 25, 2005 | (KR) | 10-2005-0100680 |
| Dec. 19, 2005 | (KR) | 10-2005-0125251 |
| Dec. 19, 2005 | (KR) | 10-2005-0125252 |
| Dec. 19, 2005 | (KR) | 10-2005-0125253 |
| Dec. 19, 2005 | (KR) | 10-2005-0125254 |
| Dec. 19, 2005 | (KR) | 10-2005-0125255 |
| Dec. 19, 2005 | (KR) | 10-2005-0125256 |
| Dec. 19, 2005 | (KR) | 10-2005-0125257 |
| Dec. 19, 2005 | (KR) | 10-2005-0125258 |
| Dec. 19, 2005 | (KR) | 10-2005-0125259 |
| Dec. 19, 2005 | (KR) | 10-2005-0125260 |
| Dec. 19, 2005 | (KR) | 10-2005-0125261 |
| Dec. 19, 2005 | (KR) | 10-2005-0125262 |
| Dec. 19, 2005 | (KR) | 10-2005-0125263 |
| Dec. 19, 2005 | (KR) | 10-2005-0125264 |
| Dec. 19, 2005 | (KR) | 10-2005-0125265 |

(51) Int. Cl.
*C22C 38/16* (2006.01)
*C22C 38/10* (2006.01)
*C21D 8/04* (2006.01)

(52) U.S. Cl. ..... 420/89; 420/90; 420/91; 420/92; 420/104; 420/107; 148/320; 148/332; 148/333; 148/334; 148/335; 148/336; 148/603; 148/651

(58) Field of Classification Search ..... 148/320, 148/332–336, 603, 651; 420/89–92, 104, 420/105, 107
See application file for complete search history.

(56) References Cited

U.S. PATENT DOCUMENTS

| | | | | |
|---|---|---|---|---|
| 3,159,511 | A | 12/1964 | Taguchi et al. | |
| 3,163,564 | A | 12/1964 | Taguchi et al. | |
| 4,729,929 | A | 3/1988 | Shinoda et al. | |
| 6,773,518 | B2 * | 8/2004 | Yoon et al. | 148/332 |
| 2005/0230012 | A1 | 10/2005 | Usami et al. | |

FOREIGN PATENT DOCUMENTS

| | | | |
|---|---|---|---|
| CN | 1383457 | A | 12/2002 |
| EP | 1094126 | * | 4/2001 |
| EP | 1 245 689 | A2 | 10/2002 |
| EP | 1 308 532 | A2 | 5/2003 |
| JP | 5-140652 | | 6/1993 |
| JP | 7-278739 | | 10/1995 |
| JP | 407278739 | * | 10/1995 |
| JP | 8-225832 | | 9/1996 |
| JP | 10-110237 | A | 4/1998 |
| JP | 11-131179 | A | 5/1999 |
| KR | 2003-0047470 | A | 6/2003 |
| KR | 10-2004-0091523 | | 10/2004 |
| WO | WO 01/94654 | A1 | 12/2001 |
| WO | WO 2004/063400 | A1 | 7/2004 |

OTHER PUBLICATIONS

Office Action dated Jan. 8, 2010, issued by Chinese Patent Office in Chinese Patent Application No. 200680039935.4 (15 pages total w/translation).

Extended European Search Report for European Application No. EP 06 81 2216 dated May 12, 2010, 8 pages.

* cited by examiner

*Primary Examiner* — Deborah Yee

(74) *Attorney, Agent, or Firm* — Finnegan, Henderson, Farabow, Garrett & Dunner, L.L.P.

(57) ABSTRACT

Provided are a steel sheet for an automotive muffler and a method for producing the steel sheet. The steel sheet includes 0.01% by weight or less of C, 0.1 to 0.3% by weight of Si, 0.3 to 0.5% by weight of Mn, 0.015% by weight or less of P, 0.015% or less by weight of S, 0.02 to 0.05% by weight of Al, 0.004% or less of N, 0.2 to 0.6% by weight of Cu, 0.01 to 0.04% by weight of Co, and a remainder of Fe and unavoidable impurities. The method includes 0.01% by weight or less of C, 0.1 to 0.3% by weight of Si, 0.3 to 0.5% by weight of Mn, 0.015% by weight or less of P, 0.015% or less by weight of S, 0.02 to 0.05% by weight of Al, 0.004% or less of N, 0.2 to 0.6% by weight of Cu, 0.01 to 0.04% by weight of Co, and a remainder of Fe and unavoidable impurities, preparing a hot rolled steel sheet by re-heating the steel slab and by, during a finish rolling process, hot-rolling the steel slab at a temperature that is an Ar3 transformation temperature or more, preparing a cold rolled steel sheet by cold-rolling the hot rolled steel sheet with a cold reduction ratio of 50 to 90%, and performing a continuous annealing for the cold rolled steel sheet at a temperature of 500 to 900° C.

19 Claims, 2 Drawing Sheets

(a)

(b)

CORROSION RESISTANCE IMPROVED STEEL SHEET FOR AUTOMOTIVE MUFFLER AND METHOD OF PRODUCING THE STEEL SHEET

BACKGROUND OF THE INVENTION (a) Field of the Invention

The present invention relates to a steel sheet used under a high temperature and corrosion environment, and in particular, to a steel sheet for an automotive muffler, which is excellent in corrosion resistance against condensed water generated in the automotive muffler, impact resistance, and a product's service life.

(b) Description of Related Art

An automotive vehicle or electronic appliance has a variety of components formed of a steel sheet. Many of the components are used under a high temperature and corrosion environment.

A muffler of an exhaust system of the automotive vehicle may be exampled as the component used under the high temperature corrosion environment.

The muffler functions to cool and exhaust high temperature/high pressure combustion gas and reduce the exhaust noise. The muffler includes a muffler body, an exhaust pipe connected to the muffler body, and a flange for coupling the exhaust pipe to the muffler body. Although there may be a difference according to a kind of the automotive vehicles, a plurality of partitions and a plurality of small pipes are generally installed in the muffler body in order to reduce the noise generated in the muffler body.

The automotive muffler is not used under a constant temperature environment but under an environment where the temperature increases and decreases according to the driving state of the automotive vehicle. In addition, combustion gas generated from an engine passes through the automotive muffler, in the course of which the combustion gas reacts with moisture in the muffler to generate condensed water. The condensed water contains high corrosive combustion gas ions such as $SO_3^{2-}$, $NH_4^+$, $SO_4^{2-}$, $Cl^-$, $NO_2$, or $NO_3^-$.

When the automotive vehicle is run for a long time, an internal corrosion is generated in the muffler due to the condensed water generated in the muffler. In addition, an external corrosion is generated on the muffler due to, for example, a deicing agent such as calcium chloride.

Due to the above reason, the automotive muffler must be formed of a material that is excellent in corrosion resistance, heat resistance, and impact resistance.

A steel sheet coated with aluminum and a stainless steel sheet are well known as a typical steel sheet used for producing the automotive muffler.

The steel sheet coated with the aluminum is not appropriate for the muffler material since the aluminum is costly compared with the steel sheet. In addition, when the steel sheet coated with the aluminum is used for a long time, the aluminum coating layer is corroded and thus the steel sheet corresponding to the corroded portion of the aluminum plaiting layer is quickly corroded. In order to solve this corrosion problem, there is a method for increasing a thickness of the aluminum coating layer. However, as the thickness of the aluminum coating layer increases, the production costs increase. Furthermore, there is a technical limitation in increasing the thickness of the aluminum coating layer to a certain level. Therefore, the steel sheet coated with the aluminum has many problems in terms of the corrosion resistance and the production costs to be used as a material for producing the automotive muffler.

Although the stainless steel sheet that is another material for producing the automotive muffler is known that it is relatively excellent in the corrosion resistance, the stainless steel sheet is costly as it is. In addition, since the automotive muffler is generally used under an environment where the variation of the temperature fluctuates from a high temperature to a constant temperature or from a constant temperature to a high temperature, the stainless steel sheet encounters a high temperature corrosion resistance problem of itself.

In order to solve the problem, the improvement of a property of the coating layer formed on the steel sheet, the change of a component of the stainless steel sheet, or the stainless steel sheet coated with the aluminum has been proposed.

Japanese laid-open patent No. 1999-269605 discloses a stainless steel sheet coated with aluminum. A composition of the stainless steel includes less than 0.004% by weight of C, 0.04 to 0.08% by weight of P, equal to or less than 0.01% by weight of S, 0.02 to 0.10% by weight of Ti, and equal to or less than less than 0.003% by weight of N. Zn—Al alloy including 30 to 70% by weight of Al, 0.5 to 2.5% by weight of Si, and a remainder of Zn is coated on one side or both sides of the steel plate.

However, the steel sheet coated with the Zn—Al-based alloy of the patent still has a problem that the corrosion resistance thereof is not sufficient.

Japanese laid-open patent No. 1990-270521 discloses a stainless steel that is coated with aluminum to enhance the corrosion resistance. Japanese laid-open patent No. 1976-136792 discloses a steel sheet whose components are adjusted to improve the welding property.

Since the steel sheets of the above two patents still contain a large amount of expensive alloy iron such as Ni-based alloy iron or Cr-based alloy iron, it has a problem in that the production costs increase.

SUMMARY OF THE INVENTION

Therefore, the present invention has been made in an effort to solve the above-described problems and it is an object of the present invention to provide a steel sheet for an automotive muffler, which can be inexpensively produced and excellent in corrosion resistance against condensed water and strength.

Another object of the present invention is to provide a method of producing a steel sheet for an automotive muffler, which can be inexpensively produced and excellent in corrosion resistance against condensed water and strength.

According to a first embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% or less by weight of S, 0.02 to 0.05% by weight of Al, 0.004% or less of N, 0.2 to 0.6% by weight of Cu, 0.01 to 0.04% by weight of Co, and a remainder of Fe and unavoidable impurities.

According to a second embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, and a remainder of Fe and unavoidable impurities.

According to a third embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, and a remainder of Fe and unavoidable impurities.

According to a fourth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.1 to 0.3% by weight of Cr, and a remainder of Fe and unavoidable impurities.

According to a fifth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, and a remainder of Fe and unavoidable impurities.

According to a sixth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.1 to 0.3% by weight of Cr, and a remainder of Fe and unavoidable impurities.

According to a seventh embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.1 to 0.3% by weight of Cr, and a remainder of Fe and unavoidable impurities.

According to a eighth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, 0.1 to 0.3% by weight of Cr, and a remainder of Fe and unavoidable impurities.

According to a ninth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.005 to 0.05% by weight of Nb, and a remainder of Fe and unavoidable impurities, wherein a value T, which is defined by "T=60−280*C(%)−15*Si(%)−20*Mn(%)−12*Cu(%)−10*Co(%)," is 35 or more and a value of Nb/C, which is defined by "Nb/C=(Nb(%)/93)/(C(%)/12)," is 0.5 to 2.0.

According to a tenth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10*Ni(%)," is 35 or more and a value of Nb/C, which is defined by "Nb/C=(Nb(%)/93)/(C(%)/12)," is 0.5 to 2.0.

According to an eleventh embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−8*Mo(%)," is 35 or more and a value of Nb/C, which is defined by "Nb/C=(Nb(%)/93)/(C(%)/12)," is 0.5 to 2.0.

According to a twelfth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−8*Cr(%)," is 35 or more and a value of Nb/C, which is defined by "Nb/C=(Nb(%)/93)/(C(%)/12)," is 0.5 to 2.0.

According to a thirteenth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, $O_2$ to 04% by weight of Ni, 0.05 to 0.2% by weight of Mo, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10 Ni(%)−8*Mo(%)," is 35 or more and a value of Nb/C, which is defined by "Nb/C=(Nb(%)/93)/(C(%)/12)," is 0.5 to 2.0.

According to a fourteenth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, $O_2$ to 04% by weight of Ni, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10*Ni(%)−8*Cr(%)," is 35 or more and a value of Nb/C, which is defined by "Nb/C=(Nb(%)/93)/(C(%)/12)," is 0.5 to 2.0.

According to a fifteenth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−8*Mo(%)−8*Cr(%)," is 35 or more and a value of Nb/C, which is defined by "Nb/C=(Nb(%)/93)/(C(%)/12)," is 0.5 to 2.0.

According to a sixteenth embodiment of the present invention, a steel sheet for an automotive muffler includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, 0.1 to 0.3% by weight of Cr, 0.005 to 0.05% by weight of Nb, and a remainder of Fe and unavoidable impurities, wherein a value T, which is defined by "T=60−280*C(%)−15*Si(%)−20*Mn(%)−12*Cu(%)−10*Co(%)−10*Ni(%)−8*Mo(%)−8*Cr(%)," is 35 or more and a value of Nb/C, which is defined by "Nb/C=(Nb(%)/93)/(C(%)/12)," is 0.5−2.0.

According to another aspect of the present invention, there is provided a method of producing a steel sheet for an automotive muffler, including: preparing a steel slab comprising 0.01% by weight or less of C, 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N, 0.2 to 0.6% by weight of Cu; 0.01 to 0.04% by weight of Co; and a remainder of Fe and unavoidable impurities, preparing a hot rolled steel sheet by re-heating the steel slab and by, during a finish rolling process, hot-rolling the steel slab at a temperature that is an Ar3 transformation temperature or more; preparing a cold rolled steel sheet by cold-rolling the hot rolled steel sheet with a cold reduction ratio of 50 to 90%; and performing a continuous annealing for the cold rolled steel sheet at a temperature of 500 to 900° C. for 10 seconds or more.

In preparing the hot rolled steel sheet, the hot rolled steel sheet may be rolled at a rolling temperature of 600° C. or more.

In performing the continuous annealing, the continuous annealing may be performed for 10 seconds to 30 minutes.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
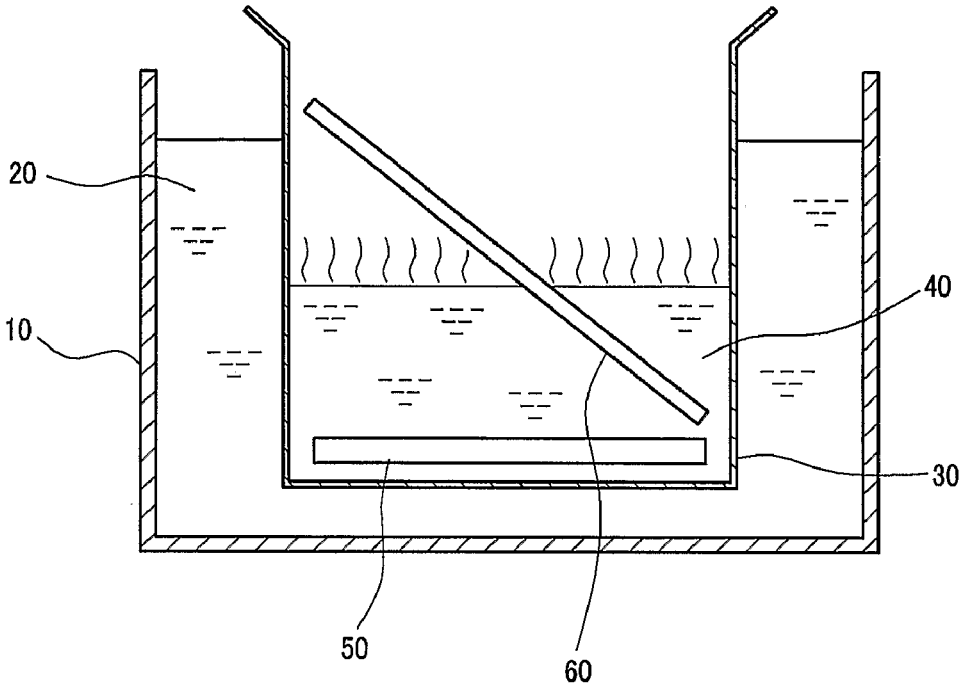
FIG. 1 is a schematic view of a test apparatus used for a corrosion resistance test against condensed liquid according to an embodiment of the present invention.

The present invention will be described more fully hereinafter with reference to the accompanying drawings, in which preferred embodiments of the invention are shown.

A steel sheet for an automotive muffler according to a first embodiment of the present invention includes 0.01% by weight or less of C, 0.1 to 0.3% by weight of Si, 0.3 to 0.5% by weight of Mn, 0.015% by weight or less of P, 0.015% or less by weight of S, 0.02 to 0.05% by weight of Al, 0.004% or less of N, 0.2 to 0.6% by weight of Cu, 0.01 to 0.04% by weight of Co, and a remainder of Fe and unavoidable impurities.

A steel sheet for an automotive muffler according to a second embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, and a remainder of Fe and unavoidable impurities.

A steel sheet for an automotive muffler according to a third embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, and a remainder of Fe and unavoidable impurities.

A steel sheet for an automotive muffler according to a fourth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.1 to 0.3% by weight of Cr, and a remainder of Fe and unavoidable impurities.

A steel sheet for an automotive muffler according to a fifth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, and a remainder of Fe and unavoidable impurities.

A steel sheet for an automotive muffler according to a sixth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.1 to 0.3% by weight of Cr, and a remainder of Fe and unavoidable impurities.

A steel sheet for an automotive muffler according to a seventh embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.1 to 0.3% by weight of Cr, and a remainder of Fe and unavoidable impurities.

A steel sheet for an automotive muffler according to an eighth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, 0.1 to 0.3% by weight of Cr, and a remainder of Fe and unavoidable impurities.

A steel sheet for an automotive muffler according to a ninth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.005 to 0.05% by weight of Nb, and a remainder of Fe and unavoidable impurities, wherein a value T, which is defined by "T=60−280*C(%)−15*Si(%)−20*Mn(%)−12*Cu(%)−10*Co(%)," is 35 or more and a value of Nb/C, which is defined by "Nb/C=(Nb(%)/93)/(C(%)/12)," is 0.5 to 2.0.

A steel sheet for an automotive muffler according to a tenth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10*Ni(%)," is 35 or more and a value of Nb/C, which is defined by "Nb/C=(Nb(%)/93)/(C(%)/12)," is 0.5 to 2.0.

A steel sheet for an automotive muffler according to an eleventh embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.005 to 0.05% by weight of Nb, and a remainder of Fe and unavoidable impurities, wherein a value T, which is defined by "T=60-780*C(%)−15*Si(%)−20*Mn(%)−12*Cu(%)−10*Co(%)−8*Mo(%)," is 35 or more and a value of Nb/C, which is defined by "Nb/C=(Nb(%)/93)/(C(%)/12)," is 0.5 to 2.0.

A steel sheet for an automotive muffler according to a twelfth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−8*Cr(%)," is 35 or more and a value of Nb/C, which is defined by "Nb/C=(Nb(%)/93)/(C(%)/12)," is 0.5 to 2.0.

A steel sheet for an automotive muffler according to a thirteenth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, $O_2$ to 04% by weight of Ni, 0.05 to 0.2% by weight of Mo, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10*Ni(%)−8*Mo(%)," is 35 or more and a value of Nb/C, which is defined by "Nb/C=(Nb(%)/93)/(C(%)/12)," is 0.5 to 2.0.

A steel sheet for an automotive muffler according to a fourteenth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, $O_2$ to 04% by weight of Ni, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−10*Ni(%)−8*Cr(%)," is 35 or more and a value of Nb/C, which is defined by "Nb/C=(Nb(%)/93)/(C(%)/12)," is 0.5 to 2.0.

A steel sheet for an automotive muffler according to a fifteenth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.05 to 0.2% by weight of Mo, 0.1 to 0.3% by weight of Cr, 0.005 to 0.05% by weight of Nb, and a remainder of Fe and unavoidable impurities, wherein a value T, which is defined by "T=60−780*C(%)−15*Si(%)−20*Mn(%)−12*Cu(%)−10*Co(%)−8*Mo(%)−8*Cr(%)," is 35 or more and a value of Nb/C, which is defined by "Nb/C=(Nb(%)/93)/(C(%)/12)," is 0.5 to 2.0.

A steel sheet for an automotive muffler according to a sixteenth embodiment of the present invention includes 0.01% by weight or less of C, 0.1 to 0.3% by weight of Si, 0.3 to 0.5% by weight of Mn, 0.015% by weight or less of P, 0.015% by weight or less of S, 0.02 to 0.05% by weight of Al, 0.004% or less of N, 0.2 to 0.6% by weight of Cu, 0.01 to 0.04% by weight of Co, 0.2 to 0.4% by weight of Ni, 0.05 to 0.2% by weight of Mo, 0.1 to 0.3% by weight of Cr, 0.005 to 0.05% by weight of Nb, and a remainder of Fe and unavoidable impurities, wherein a value T, which is defined by "T=60−280*C(%)−15*Si(%)−20*Mn(%)−12*Cu(%)−10*Co(%)−10*Ni(%)−8*Mo(%)−8*Cr(%)," is 35 or more and a value of Nb/C, which is defined by "Nb/C=(Nb(%)/93)/(C(%)/12)," is 0.5-2.0.

The reason for limiting the chemical composition of the steel sheet for the automotive muffler within the ranges of the above-described embodiments will now be described.

First, content of carbon (C) may be 0.01% by weight or less. If the content of carbon (C) is greater than 0.01% by weight, a softness of the steel sheet is deteriorated and thus the process ability for manufacturing the muffler is greatly deteriorated. Therefore, the content of carbon (C) may be 0.01% by weight or less.

Content of silicon (Si) may be 0.1 to 0.3% by weight. The silicon serves to retard the condensed water corrosion by reacting moisture and generating $SiO_2$. However, when the content of silicon (Si) is less than 0.1% by weight, an amount of $SiO_2$ generated is too small to provide sufficient corrosion resistance effect. Therefore, the lower limit value of the silicon content may be 0.1% by weight. When the content of silicon (Si) is greater than 0.3% by weight, the softness is deteriorated and thus the formability is deteriorated. Therefore, the upper limit value of the silicon content may be 0.3% by weight.

Content of manganese (Mn) may be 0.3 to 0.5% by weight. It is known that the manganese functions to prevent the hot shortness caused by solid-solution sulfur by extracting sulfur contained in steel as MnS. In an embodiment of the present invention, the manganese reacts with the condensed water to generate MnO and thus enhance the corrosion resistance against the condensed water. When the content of manganese is less than 0.3% by weight, an amount of MnO generated is too small to improve the corrosion resistance. Therefore, the lower limit value of the manganese content may be 0.3% by weight. When the content of manganese is greater than 0.5% by weight, the softness is deteriorated and thus the formability is deteriorated. Therefore, the upper limit value of the manganese content may be 0.5% by weight.

Content of phosphorus (P) may be 0.015% by weight or less. When the content of phosphorus (P) is greater than 0.015% by weight, the phosphorus is segregated into a grain boundary and thus the grains are easily corroded, thereby greatly deteriorating the corrosion resistance. Furthermore, the phosphorus deteriorates the softness, thereby deteriorating the formability. Therefore, the upper limit value of the phosphorus content may be 0.015%.

Content of sulfur (S) may be 0.015% by weight or less. The sulfur does not greatly affect the corrosion resistance against the condensed water. However, the sulfur content is high, the hot shortness may occur and the formability is deteriorated. Therefore, the upper limit value of the sulfur content may be 0.015% by weight.

Content of aluminum (Al) may be 0.02 to 0.05% by weight. The aluminum is added to function as deoxidizer for extracting nitrogen contained in steel, there preventing the formability from being deteriorated by solid-solution nitrogen. Since the formability may be deteriorated by the solid-solution nitrogen when the content of the aluminum is less than 0.02% by weight, the lower limit value may be 0.02% by weight. When the aluminum content is greater than 0.05% by weight, the softness is suddenly reduced and thus the upper limit value of the aluminum content may be 0.05% by weight.

Content of nitrogen (N) may be 0.004% by weight or less. The nitrogen is a material that is unavoidably added. When the nitrogen content is greater than 0.004% by weight, the formability is deteriorated and thus the upper limit value of the nitrogen content may be 0.004%.

Content of copper (Cu) may be 0.2 to 0.6% by weight. The copper is added to the steel to function to generate CuS by reacting with sulfuric ions taking a majority share of the condensed water. The copper effectively consumes $SO_4^{2-}$ and $SO_3^{2-}$ ions, thereby dramatically increasing the corrosion resistance. When the copper content is less than 0.2% by weight, an amount of the $SO_4^{2-}$ and $SO_3^{2-}$ ions consumed is too small to improve the corrosion resistance effect. Therefore, the lower limit value of the copper content may be 0.2% by weight. In addition, when the copper content is greater than 0.6% by weight, the corrosion resistance improvement effect is small as compared with the increase of the amount of the copper and the formability is also deteriorated. Therefore, the upper limit value of the copper content may be 0.6% by weight.

Content of cobalt (Co) may be 0.01 to 0.04% by weight. Although the cobalt does not function to directly improve the corrosion resistance against the condensed water, when it is added to the steel, it functions as catalyst for the generation of CuS. Therefore, even when a small amount of the cobalt is added, it can effectively remove the $SO_4^{2-}$ and $SO_3^{2-}$ ions to greatly improve the corrosion resistance. When the cobalt content is less than 0.01% by weight, the corrosion resistance effect is not effectively improved. Therefore, the lower limit value of the cobalt content may be 0.01% by weight. When the cobalt content is greater than 0.04% by weight, the corrosion resistance improvement effect is small as compared with the increase of the added amount. Therefore, the upper limit value of the cobalt content may be 0.04% by weight.

Content of nickel (Ni) may be 0.2 to 0.4% by weight. The nickel is a corrosion resistance enhancing material. When the nickel content is less than 0.2% by weight, the corrosion resistance improvement effect is small and thus the lower limit value of the nickel content may be 0.2% by weight. When the nickel content is greater than 0.4% by weight, the cost increases and the corrosion resistance improvement effect is not so high. Therefore, the upper limit value of the nickel content may be 0.4% by weight.

Content of molybdenum (Mo) may be 0.05 to 0.2% by weight. The molybdenum is a corrosion resistance enhancing material. When the molybdenum content is less than 0.05% by weight, the corrosion resistance improvement effect is small and thus the lower limit value of the molybdenum content may be 0.05% by weight. When the molybdenum content is greater than 0.2% by weight, the cost increases and the corrosion resistance improvement effect is not so high. Therefore, the upper limit value of the molybdenum content may be 0.2% by weight.

Content of chromium (Cr) may be 0.1 to 0.3% by weight. The chromium functions to enhance the corrosion resistance by forming $Cr_2O_3$ that improves corrosion resistance against hydrochloric acid in the steel. When the chromium content is less than 0.1% by weight, the corrosion resistance improvement effect is small and thus the lower limit value of the chromium content may be 0.1% by weight. When the chromium content is greater than 0.3% by weight, the cost increase and the corrosion resistance improvement effect is not so high. Therefore, the upper limit value of the chromium content may be 0.3%.

Content of niobium (Nb) may be 0.005-0.05% by weight. The niobium extracts carbon existing in the steel to greatly improve drawability during annealing by accelerating the development of {111} texture structures. When the niobium content is less than 0.005% by weight, the development of {111} texture structures is too low to expect the drawability improvement effect. Therefore, the lower limit value of the niobium content may be 0.005% by weight. When the niobium content is greater than 0.05%, the size of the grain is reduced only to lower the drawability. Therefore, the upper limit value of the niobium content may be 0.05% by weight.

In addition, the value of Nb/C may be 0.5 to 2.0. The Nb functions to improve the drawability by extracting NbC by bonding to the carbon remained in the steel and thus reducing the content of the carbon, which is remained in the solid-solution state and interferes with the development of the {111} texture structures during annealing. When the value of Nb/C is less than 0.5, since an amount of the carbon remained in the solid-solution state, the drawability improvement effect is very small and thus the lower limit value of Nb/C may be 0.5. When the value of Nb/C is greater than 2.0, an amount of the Nb remained in the solid-solution state is too much. Therefore, the drawability is deteriorated and thus the upper limit value may be 2.0.

The value T has an interrelation to stretching process ability. Since at least one of the drawability and the stretching process ability is important depending on the processing product, the value T representing the stretching process ability is very important process index. When the value T defined by "T=60−280*C(%)−15*Si(%)−20*Mn(%)−12*Cu(%)−10*Co(%)" is less than 35, the stretching process ability is deteriorated and thus the steel sheet cannot be used as a material for the muffler. Therefore, the value T may be 35 or more.

The main corrosion of the automotive muffler is hole-corrosion caused by the reaction between sulfuric ions contained in the condensed water and Fe ions of the steel sheet. Furthermore, the sulfuric ions contained in the condensed water react with the Fe ions of the steel sheet to generate $FeSO_4$. The $FeSO_4$ is re-dissociated by the condensed water to regenerate the sulfuric ions. This causes the continuous corrosion.

Therefore, in the embodiments of the present invention, the added copper reacts with the sulfuric ions to generate $Cu_2S$. The $Cu_2S$ suppresses the regeneration of the sulfuric ions by the $FeSO_4$, thereby preventing the steel sheet from being corroded by the condensed water.

In addition, in the embodiments of the present invention, the added cobalt functions as catalyst for promoting the generation of the $Cu_2S$.

Therefore, in the embodiments of the present invention, the copper and cobalt react with each other to drastically reduce the corrosion caused by the condensed water.

In the above description, only the components of the steel sheet for the automotive muffler are described. However, in order to obtain the softness required for processing the muffler, the value T may be determined according to the following equations depending on each embodiment.

$$T: 60-280*C(\%)-15*Si(\%)-20*Mn(\%)-12*Cu(\%)-10*Co(\%)\geqq 35 \quad \text{Equation 1}$$

$$T: 60-780*C(\%)-15*Si(\%)-20*Mn(\%)-12*Cu(\%)-10*Co(\%)-10*Ni\geqq 35 \quad \text{Equation 2}$$

$$T: 60-780*C(\%)-15*Si(\%)-20*Mn(\%)-12*Cu(\%)-10*Co(\%)-8*Mo(\%)\geqq 35 \quad \text{Equation 3}$$

$$T: 60-780*C(\%)-15*Si(\%)-20*Mn(\%)-12*Cu(\%)-10*Co(\%)-8*Cr(\%)\geqq 35 \quad \text{Equation 4}$$

$$T: 60-780*C(\%)-15*Si(\%)-20*Mn(\%)-12*Cu(\%)-10*Co(\%)-10*Ni(\%)-8*Mo(\%)\geqq 35 \quad \text{Equation 5}$$

$$T: 60-780*C(\%)-15*Si(\%)-20*Mn(\%)-12*Cu(\%)-10*Co(\%)-10*Ni(\%)-8*Cr(\%)\geqq 35 \quad \text{Equation 6}$$

$$T: 60-780*C(\%)-15*Si(\%)-20*Mn(\%)-12*Cu(\%)-10*Co(\%)-8*Mo(\%)-8*Cr(\%)\geqq 35 \quad \text{Equation 7}$$

$$T: 60-280*C(\%)-15*Si(\%)-20*Mn(\%)-12*Cu(\%)-10*Co(\%)-10*Ni(\%)-8*Mo(\%)-8*Cr(\%)\geqq 35 \quad \text{Equation 8}$$

As described above, in the present invention, the composition of the steel sheet is controlled within the range of Equations 1 through 8 so that the corrosion resistance against the condensed water can be ensured by the interaction between the silicon, copper and cobalt and the process ability can be ensured by the interaction between the carbon and base metal (Fe), thereby providing a desired steel sheet for the automotive muffler.

A method for producing a steel sheet for an automotive muffler according to a variety of embodiments will be described hereinafter.

First, a steel slab including a basic composition 0.01% by weight or less of C, 0.1 to 0.3% by weight of Si, 0.3 to 0.5% by weight of Mn, 0.015% by weight or less of P, 0.015% or less by weight of S, 0.02 to 0.05% by weight of Al, 0.004% or less of N, 0.2 to 0.6% by weight of Cu, and 0.01 to 0.04% by weight of Co, other additional components of each embodiment, and a remainder of Fe and unavoidable impurities is produced through a conventional steel manufacturing process.

The produced slab is re-heated and goes through a hot rolling process under conventional conditions. At this point, during finishing rolling of the hot rolling process, a rolling temperature may be an Ar3 transformation temperature or more.

When the finishing rolling temperature is less than the Ar3 transformation temperature, rolling grains are generated and thus the process ability as well as the softness is greatly deteriorated.

After the finishing rolling, a coiling temperature of the coil gone through the hot rolling process may be 600° C. or more. When the coiling temperature is less than 600° C., AlN contained in the steel is not extracted and thus solid-solution nitrogen is still remained in the steel. This may cause the deterioration of the formability of the steel sheet.

The hot-rolled steel sheet is cold-rolled using a cold roller.

At this point, the cold rolling may be performed with a cold reduction ratio of 50 to 90%. When the cold reduction ratio is less than 50%, a nuclear fission yield by the recrystallization is low and thus the recrystallized grain size increases and thus the strength and formability of the steel sheet are deteriorated.

When the cold reduction ratio is greater than 90%, the formability may be improved but the nuclear fission yield is too high and thus the size of the recrystallized grain is too fine. This causes the deterioration of the softness of the steel sheet.

The cold-rolled steel sheet is continuous-annealed in a continuous annealing furnace. At this point, a continuous annealing temperature functions to determine the quality of the finalized steel sheet.

Accordingly, the temperature of the continuous annealing temperature may 500 to 900° C. When the continuous annealing temperature is less than 500° C., the recrystallization is not finished and thus the desired softness property cannot be obtained. When the continuous annealing temperature is greater than 900° C., the recrystallized grain is coarsened and thus the strength of the steel sheet is deteriorated.

The continuous annealing time may vary depending on a thickness of the steel sheet. For example, in order to finish the recrystallization, the continuous annealing time may 10 seconds or more, preferable, 10 second to 30 minutes.

The following will described the embodiments of the present invention in more detail.

First Embodiment

In the first embodiment, the slabs were produced to have the chemical composition as in Table 1.

TABLE 1

| | Chemical Components (% by weight) | | | | | | | | | |
|---|---|---|---|---|---|---|---|---|---|---|
| No. | C | Si | Mn | P | S | Al | N | Cu | Co | Ti |
| Test Example 11 | 0.0025 | 0.19 | 0.33 | 0.009 | 0.01 | 0.034 | 0.0024 | 0.27 | 0.018 | 0 |
| Test Example 12 | 0.0032 | 0.2 | 0.4 | 0.009 | 0.008 | 0.04 | 0.0028 | 0.38 | 0.013 | 0 |
| Test Example 13 | 0.0022 | 0.24 | 0.38 | 0.012 | 0.012 | 0.034 | 0.0013 | 0.55 | 0.035 | 0 |

TABLE 1-continued

| No. | Chemical Components (% by weight) | | | | | | | | | |
|---|---|---|---|---|---|---|---|---|---|---|
| | C | Si | Mn | P | S | Al | N | Cu | Co | Ti |
| Test Example 14 | 0.004 | 0.18 | 0.42 | 0.008 | 0.011 | 0.035 | 0.0025 | 0.3 | 0.029 | 0 |
| Test Example 15 | 0.0018 | 0.15 | 0.35 | 0.011 | 0.01 | 0.019 | 0.0018 | 0.52 | 0.014 | 0 |
| Test Example 16 | 0.0023 | 0.22 | 0.38 | 0.012 | 0.008 | 0.028 | 0.0032 | 0.44 | 0.039 | 0 |
| Test Example 17 | 0.0059 | 0.24 | 0.45 | 0.011 | 0.009 | 0.032 | 0.0016 | 0.3 | 0.029 | 0 |
| Test Example 18 | 0.0016 | 0.15 | 0.33 | 0.008 | 0.01 | 0.042 | 0.0014 | 0.36 | 0.036 | 0 |
| Comparative Example 11 | 0.0022 | 0.03 | 0.05 | 0.008 | 0.01 | 0.032 | 0.0015 | 0.28 | 0 | 0 |
| Comparative Example 12 | 0.0022 | 0.2 | 0.21 | 0.01 | 0.009 | 0.035 | 0.002 | 0 | 0.02 | 0 |
| Comparative Example 13 | 0.016 | 0.25 | 0.32 | 0.009 | 0.011 | 0.03 | 0.0019 | 0.22 | 0.039 | 0 |
| Comparative example 14 | 0.0018 | 0.03 | 0.25 | 0.013 | 0.008 | 0.033 | 0.0028 | 0 | 0 | 0.04 |

The produced slabs were re-heated at temperature of 1200° C. and hot-rolled in a hot-roller. Then, the slabs went through a finish hot rolling process at a temperature of 900° C. Next, the slabs were rolled at temperature of 650° C., thereby manufacturing hot-rolled steel sheets.

Each of the hot-rolled steel sheets was partly cut and the cut steel sheet piece was cleaned in 10% hydrochloric acid solution to remove the oxide scale from the surface of the steel sheet. Then, the steel sheet piece was cold-rolled with the cold reduction ratio of 70% in the cold roller and loaded in the continuous annealing furnace to go though the continuous annealing process.

The steel sheet piece loaded in the continuous annealing furnace was heated for 40 seconds at a temperature of 830° C. after increasing the temperature at a speed of 10° C./S.

In order to identify mechanical properties of the steel sheets manufactured as described above, the steel sheets was tested using the following methods.

Standard samples were processed according to ASTM-8 standard in order to identify the mechanical properties of the manufactured steel sheets.

Yield strength, tensile strength, an elongation ratio, a plastic anisotropic index ($r_m=(r_0+2r_{45}+r_{90})/4$), and an aging index (Al) were measured with tensile tester (INSTRON Co., Model No. 6025) for the samples.

In addition, the corrosion resistances of the manufacture steel sheets against the condensed water were evaluated as follows.

First, condensed water having a composition similar to that of the condensed water generated in the automotive muffler was manufactured as in Table 2.

Each of the manufactured steel sheets was cut in a size of 40 mm×40 mm to provide a sample for testing the corrosion resistance against the condensed water.

The samples are settled in the condensed water having the composition of Table 2, heated at a temperature of 80° C., and maintained for 12 hours. When this condensed water test is one cycle, 10 cycles were performed and a thickness reduction rate of each sample was measured to evaluate the corrosion resistance of the sample against the condensed water.

The corrosion resistance evaluation against the condensed water was tested using 2-bath system shown in FIG. 1. That is, as shown in FIG. 1, after containing water in a water bath 10 and heating the water bath 10 using a heater (not shown), a test container 30 was installed in the water bath 10 in which a proper amount of condensed water solution 40 is contained.

In this state, while heating the water bath using the heater, a first sample 50 was completely dipped in the condensed water solution 40 and a second sample 60 was partly dipped in the condensed water solution 40. That is, a part of the second sample 60 was dipped in the condensed water solution 40 while the rest was placed out of the condensed water solution 40 so as to evaluate the corrosion resistance of the sample 60 against the steam vaporized by the heating of the condensed water solution 40.

The evaluation result of the mechanical properties and corrosion resistance against the condensed water, which are measured according to the first embodiment, is illustrated in Table 3.

TABLE 2

| Composition of Condensed Water (ppm) | | | | | | | | |
|---|---|---|---|---|---|---|---|---|
| $Cl^-$ | $SO_4^{2-}$ | $CO_3^{2-}$ | $NO_3^-$ | $NH_4^+$ | HCOOH | $SO_3^-$ | $CH3COO^-$ | pH |
| 600 | 2000 | 2000 | 200 | 3000 | 200 | 1200 | 800 | 3.2 |

TABLE 3

| No. | Mechanical Properties | | | | Thickness reduction Due to Corrosion |
|---|---|---|---|---|---|
| | Yield Strength (MPa) | Tensile Strength (MPa) | Elongation Ratio (%) | Plastic Anisotropic Index ($r_m$) | after 10 Cycle ($g/m^2$) |
| Test Example 11 | 230 | 348 | 43 | 1.55 | 640 |
| Test Example 12 | 244 | 350 | 42 | 1.44 | 628 |
| Test Example 13 | 250 | 356 | 42 | 1.44 | 612 |
| Test Example 14 | 245 | 346 | 42 | 1.41 | 654 |
| Test Example 15 | 250 | 351 | 41 | 1.40 | 592 |
| Test Example 16 | 242 | 349 | 41 | 1.45 | 638 |
| Test Example 17 | 258 | 355 | 40 | 1.40 | 648 |
| Test Example 18 | 247 | 340 | 43 | 1.42 | 640 |
| Comparative Example 11 | 204 | 321 | 45 | 1.54 | 852 |
| Comparative Example 12 | 238 | 343 | 44 | 1.55 | 903 |
| Comparative Example 13 | 289 | 370 | 38 | 1.21 | 804 |
| Comparative Example 14 | 187 | 284 | 47 | 1.89 | 1093 |

As can be noted from Table 3, in Test Examples 11 through 18 according to the first embodiment of the present invention, a thickness reduction rate due to the corrosion is less than 660 $g/m^2$.

On the contrary, in Comparative Examples 11 through 13, it can be noted that a thickness reduction rate due to the corrosion is greater than 800 $g/m^2$. Particularly, in case of Comparative Example 14 where the titanium is added, the thickness reduction rate due to the corrosion is 1000 $g/m^2$.

In case of Comparative Examples 11 and 12, since the Cu or Co is independently added and thus it cannot function to improve the corrosion resistance, the thickness reduction rate due to the corrosion is very high. However, in case of Comparative examples 11 and 12, the corrosion resistance against the condensed water is better than that of the comparative example 14 where the titanium is added.

Meanwhile, in case of Comparative Example 13, since the carbon content is out of the composition range of the first embodiment, the thickness reduction rate is 804 $g/m^2$ higher than those of Test Examples and the elongation ratio is 38% lower than those of Test Examples.

As can be noted from the above tests, Test Examples of the first embodiment have lower corrosion thickness reduction rates as compared with Comparative examples. That is, it can be noted that the steel sheet according to the first embodiment is excellent in corrosion resistance.

Regarding the mechanical properties, it can also be noted that those of Test Examples are better than those of Comparative Examples.

In the above description, the corrosion resistance evaluation is preformed from the result having a 10-cycle test. However, in the test examples of the present invention, the corrosion resistance evaluation against the condensed water was performed for the case where the test increases to a 40-cycle.

Samples evaluated for the corrosion resistance against the condensed water with the 40-cycle has compositions of Test Example 11 and Comparative Example 14 of Table 1.

Figure 2:
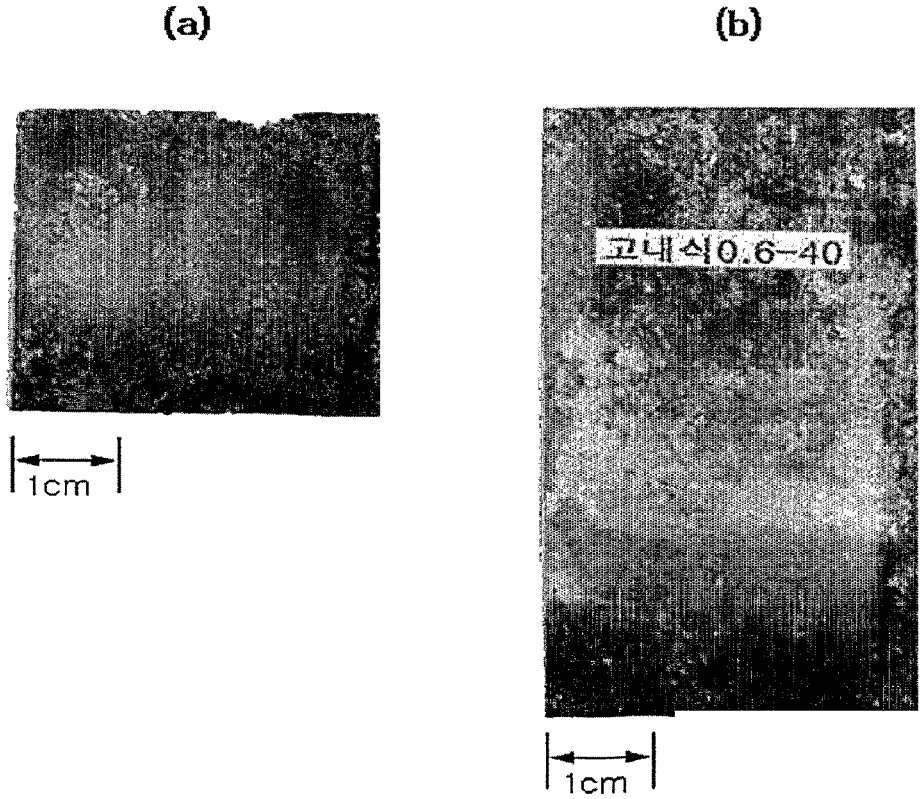
FIGS. 2*a* and 2*b* are photographs showing a surface corrosion state of a test sample according to an embodiment of the present invention after 40-cycle.
Figure 3:
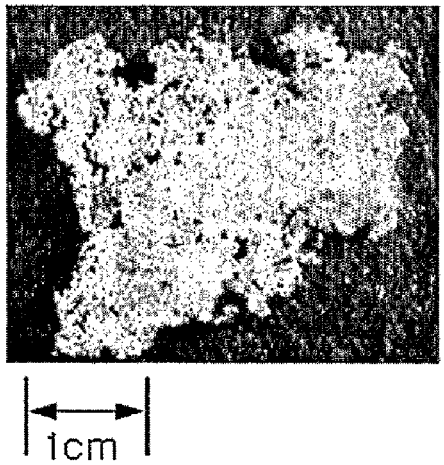
FIGS. 3*a* and 3*b* are photographs showing a surface corrosion state of a comparative test sample, which is used for the comparison with the embodiment of the present invention, after 40-cycle.
Figure 3:
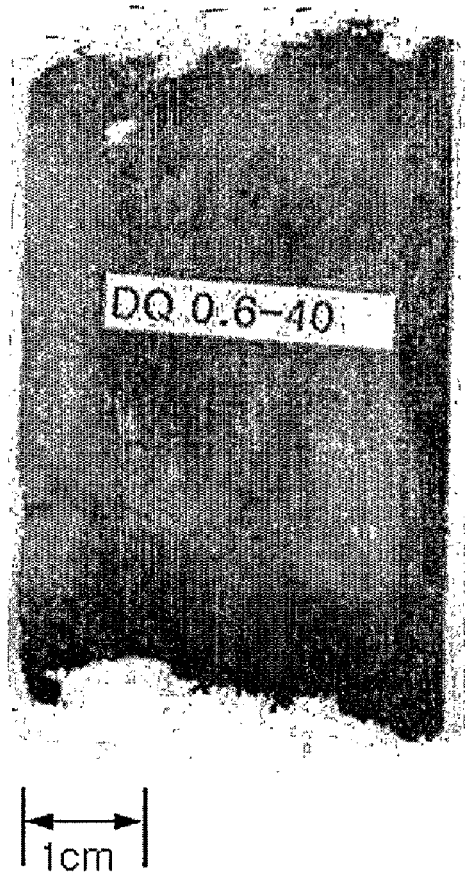

Pictures shown in FIG. 2 show a surface of the sample of Test Example 11, which is evaluated for corrosion resistance with the 40-cycle. Pictures shown in FIG. 3 show a surface of the sample of Comparative Example 4, which is evaluated for corrosion resistance with the 40-cycle with respect to Comparative Example 4.

As can be noted from a picture (a) of FIG. 2, even when the sample is fully dipped in the condensed water solution, only an upper portion of the sample is partly corroded. When the sample is partly dipped in the condensed water solution, as shown in a picture (b) of FIG. 2, the original shape of the sample is maintained but a thickness of the sample is generally reduced.

On the contrary, when the sample of the comparative example 14 is evaluated for the corrosion resistance with the 40-cycle, it can be noted from a picture (a) of FIG. 2, when the sample is fully dipped in the condensed water solution, the sample is fully corroded to a degree where the original shape of the sample cannot be identified. When the sample is partly dipped in the condensed water solution, as shown in a picture (b) of FIG. 3, the upper and lower portions of the sample are mostly corroded and removed. That is, even the upper portion that is out of the condensed water solution is corroded by steam vaporized from the condensed water solution.

Second Embodiment

In the second embodiment, the slabs were produced to have the chemical composition as in Table 4.

TABLE 4

| No. | Chemical Components (% by weight) | | | | | | | | | | |
|---|---|---|---|---|---|---|---|---|---|---|---|
| | C | Si | Mn | P | S | Al | N | Cu | Ni | Co | Ti |
| Test Example 21 | 0.0029 | 0.18 | 0.46 | 0.009 | 0.01 | 0.03 | 0.0022 | 0.25 | 0.25 | 0.035 | 0 |
| Test Example 22 | 0.0025 | 0.21 | 0.37 | 0.011 | 0.009 | 0.023 | 0.0032 | 0.39 | 0.33 | 0.024 | 0 |
| Test Example 23 | 0.0029 | 0.26 | 0.35 | 0.009 | 0.009 | 0.029 | 0.0028 | 0.35 | 0.3 | 0.035 | 0 |
| Test Example 24 | 0.0015 | 0.13 | 0.35 | 0.01 | 0.011 | 0.032 | 0.002 | 0.55 | 0.35 | 0.015 | 0 |
| Comparative Example 21 | 0.0019 | 0.18 | 0.1 | 0.011 | 0.009 | 0.033 | 0.0034 | 0 | 0.33 | 0 | 0 |

TABLE 4-continued

| No. | Chemical Components (% by weight) | | | | | | | | | | |
|---|---|---|---|---|---|---|---|---|---|---|---|
| | C | Si | Mn | P | S | Al | N | Cu | Ni | Co | Ti |
| Comparative Example 22 | 0.0032 | 0.05 | 0.15 | 0.014 | 0.011 | 0.033 | 0.0024 | 0.24 | 0 | 0 | 0 |
| Comparative Example 23 | 0.017 | 0.27 | 0.37 | 0.009 | 0.013 | 0.034 | 0.003 | 0 | 0.25 | 0.043 | 0 |
| Comparative Example 24 | 0.0018 | 0.03 | 0.25 | 0.013 | 0.008 | 0.033 | 0.0028 | 0 | 0 | 0 | 0.04 |

A process for producing the heat-rolled steel sheet, a process for annealing the heat-rolled steel sheet, and a method for evaluating the physical properties of this second embodiment are same as those of the first embodiment.

The evaluation result of the mechanical properties and corrosion resistance against the condensed water, which are measured according to the second, and the value T representing the process ability of each sample are illustrated in Table 5.

TABLE 5

| No. | Mechanical Properties | | | | Thickness reduction Due to | |
|---|---|---|---|---|---|---|
| | Yield Strength (MPa) | Tensile Strength (MPa) | Elongation Ratio (%) | Plastic Anisotropic Index ($r_m$) | Corrosion after 10 Cycle after 10-Cycle (g/m$^2$) | T Value |
| Test Example21 | 261 | 351 | 42 | 1.48 | 610 | 39.988 |
| Test Example22 | 255 | 354 | 40 | 1.4 | 622 | 39.28 |
| Test Example 23 | 250 | 359 | 42 | 1.42 | 611 | 39.288 |
| Test Example 24 | 250 | 354 | 40 | 1.45 | 593 | 39.63 |
| Comparative Example 21 | 217 | 327 | 45 | 1.55 | 903 | 50.518 |
| Comparative Example 22 | 239 | 347 | 43 | 1.38 | 874 | 50.874 |
| Comparative Example 23 | 259 | 369 | 39 | 1.21 | 902 | 32.36 |
| Comparative Example 24 | 197 | 284 | 47 | 1.89 | 1093 | 53.146 |

As can be noted from Table 5, in Test Examples 21 through 24 according to the second embodiment of the present invention, a thickness reduction rate due to the corrosion is less than 622 g/m$^2$.

On the contrary, in Comparative Examples 21 through 13, it can be noted that a thickness reduction rate due to the corrosion is greater than 870 g/m$^2$. Particularly, in case of Comparative Example 24 where the titanium is added, the thickness reduction rate due to the corrosion is 1000 g/m$^2$.

In case of Comparative Examples 21 and 22, since the Cu or Co is independently added and thus it cannot function to improve the corrosion resistance, the thickness reduction rate due to the corrosion is very high. However, in case of Comparative examples 21 and 22, the corrosion resistance against the condensed water is better than that of the comparative example 24 where the titanium is added.

Meanwhile, in case of Comparative Example 23, since the carbon contents is out of the composition range of the second embodiment, the thickness reduction rate is 902 g/m$^2$ higher than those of Test Examples and the elongation ratio is 38% lower than those of Test Examples.

As can be noted from the above tests, Test Examples of the second embodiment have lower corrosion thickness reduction rates as compared with Comparative examples. That is, it can be noted that the steel sheet according to the second embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Third Embodiment

In the third embodiment, the slabs were produced to have the chemical composition as in Table 6.

TABLE 6

| No. | Chemical Components (% by weight) | | | | | | | | | | |
|---|---|---|---|---|---|---|---|---|---|---|---|
| | C | Si | Mn | P | S | Al | N | Cu | Mo | Co | Ti |
| Test Example 31 | 0.0019 | 0.25 | 0.35 | 0.009 | 0.011 | 0.028 | 0.0028 | 0.32 | 0.09 | 0.014 | 0 |
| Test Example 32 | 0.003 | 0.14 | 0.46 | 0.009 | 0.013 | 0.032 | 0.0019 | 0.37 | 0.11 | 0.021 | 0 |
| Test Example 33 | 0.0025 | 0.27 | 0.39 | 0.01 | 0.009 | 0.035 | 0.0032 | 0.57 | 0.08 | 0.022 | 0 |
| Test Example 34 | 0.0016 | 0.25 | 0.38 | 0.01 | 0.01 | 0.032 | 0.0019 | 0.25 | 0.19 | 0.035 | 0 |
| Comparative example 31 | 0.0019 | 0.05 | 0.11 | 0.009 | 0.009 | 0.045 | 0.0028 | 0.31 | 0 | 0 | 0 |
| Comparative Example 32 | 0.0036 | 0.35 | 0.35 | 0.011 | 0.01 | 0.03 | 0.003 | 0 | 0 | 0.038 | 0 |
| Comparative Example 33 | 0.021 | 0.25 | 0.35 | 0.009 | 0.009 | 0.029 | 0.0019 | 0.27 | 0.14 | 0. | 0 |
| Comparative example 34 | 0.0018 | 0.03 | 0.25 | 0.013 | 0.008 | 0.033 | 0.0028 | 0 | 0 | 0 | 0.04 |

A process for producing the heat-rolled steel sheet, a process for annealing the heat-rolled steel sheet, and a method for evaluating the physical properties of this third embodiment are same as those of the first embodiment.

The evaluation result of the mechanical properties and corrosion resistance against the condensed water, which are measured according to the third embodiment, and the value T representing the process ability of each sample are illustrated in Table 7.

TABLE 7

| No. | Mechanic Properties | | | | Thickness reduction Due to Corrosion after 10 Cycle ($g/m^2$) | T |
|---|---|---|---|---|---|---|
| | Yield Strength (MPa) | Tensile Strength (MPa) | Elongation Ratio (%) | Plastic Anisotropic Index ($r_m$) | | |
| Test Example31 | 253 | 360 | 41 | 1.31 | 599 | 43.068 |
| Test Example32 | 258 | 366 | 40 | 1.34 | 580 | 40.83 |
| Test Example 33 | 253 | 355 | 42 | 1.35 | 569 | 38.5 |
| Test Example 34 | 245 | 348 | 40 | 1.28 | 567 | 42.532 |
| Comparative exmaple31 | 213 | 315 | 47 | 1.55 | 812 | 51.848 |
| Comparative Example 32 | 230 | 345 | 42 | 1.41 | 902 | 44.562 |
| Comparative Example 33 | 263 | 370 | 36 | 1.18 | 869 | 28.51 |
| Comparative Example 34 | 197 | 284 | 47 | 1.89 | 1093 | 53.146 |

As can be noted from Table 7, in Test Examples 31 through 34 according to the third embodiment of the present invention, a thickness reduction rate due to the corrosion is less than 599 $g/m^2$.

On the contrary, in Comparative Examples 31 through 33, it can be noted that a thickness reduction rate due to the corrosion is greater than 810 $g/m^2$. Particularly, in case of Comparative Example 34 where the titanium is added, the thickness reduction rate due to the corrosion is 1000 $g/m^2$.

In case of Comparative Examples 31 and 32, since the Cu or Co is independently added and thus it cannot function to improve the corrosion resistance, the thickness reduction rate due to the corrosion is very high. However, in case of Comparative examples 31 and 32, the corrosion resistance against the condensed water is better than that of the comparative example 34 where the titanium is added.

Meanwhile, in case of Comparative Example 33, since the carbon contents is out of the composition range of the third embodiment, the thickness reduction rate is 869 $g/m^2$ higher than those of Test Examples and the elongation ratio is 36% lower than those of Test Examples.

As can be noted from the above tests, Test Examples of the third embodiment have lower corrosion thickness reduction rates as compared with Comparative examples. That is, it can be noted that the steel sheet according to the third embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Fourth Embodiment

In the fourth embodiment, the slabs were produced to have the chemical composition as in Table 8.

TABLE 8

| | Chemical Components (% by weight) | | | | | | | | | | |
|---|---|---|---|---|---|---|---|---|---|---|---|
| No. | C | Si | Mn | P | S | Al | N | Cu | Cr | Co | Ti |
| Test Example 41 | 0.0023 | 0.2 | 0.3 | 0.01 | 0.012 | 0.035 | 0.003 | 0.28 | 0.15 | 0.02 | 0 |
| Test Example 42 | 0.0035 | 0.17 | 0.39 | 0.009 | 0.008 | 0.044 | 0.0018 | 0.37 | 0.18 | 0.014 | 0 |
| Test Example 43 | 0.0019 | 0.25 | 0.42 | 0.013 | 0.015 | 0.053 | 0.0033 | 0.52 | 0.25 | 0.038 | 0 |
| Test Example 44 | 0.0039 | 0.19 | 0.37 | 0.007 | 0.011 | 0.065 | 0.0028 | 0.25 | 0.25 | 0.032 | 0 |
| Test Example 41 | 0.0024 | 0.03 | 0.05 | 0.008 | 0.01 | 0.03 | 0.0018 | 0.32 | 0 | 0 | 0 |
| Test Example 42 | 0.0025 | 0.22 | 0.21 | 0.009 | 0.012 | 0.045 | 0.0025 | 0 | 0.02 | 0.022 | 0 |
| Test Example 43 | 0.015 | 0.25 | 0.32 | 0.013 | 0.009 | 0.033 | 0.0019 | 0.25 | 0 | 0.42 | 0 |
| Test Example 44 | 0.0018 | 0.03 | 0.25 | 0.013 | 0.008 | 0.033 | 0.0028 | 0 | 0 | 0 | 0.04 |

A process for producing the heat-rolled steel sheet, a process for annealing the heat-rolled steel sheet, and a method for evaluating the physical properties of this fourth embodiment are same as those of the first embodiment.

The evaluation result of the mechanical properties and corrosion resistance against the condensed water, which are measured according to the fourth embodiment, and the value T representing the process ability of each sample are illustrated in Table 9.

TABLE 9

| | Mechanical Properties | | | | Thickness Reduction due | |
|---|---|---|---|---|---|---|
| No. | Yield Strength (MPa) | Tensile Strength (MPa) | Elongation Ratio (%) | Plastic Anisotropic Index ($r_m$) | to Corrosion after 10 Cycle ($g/m^2$) | T Value |
| Test Example 41 | 248 | 355 | 41 | 1.5 | 540 | 44.446 |
| Test Example 42 | 251 | 358 | 42 | 1.39 | 515 | 40.9 |
| Test Example 43 | 259 | 366 | 41 | 1.44 | 503 | 37.748 |
| Test Example 44 | 248 | 353 | 42 | 1.41 | 545 | 41.388 |
| Test Example 41 | 204 | 321 | 45 | 1.54 | 852 | 52.838 |
| Test Example 42 | 238 | 345 | 44 | 1.55 | 903 | 50.17 |

TABLE 9-continued

| No. | Mechanical Properties | | | | Thickness Reduction due to Corrosion after 10 Cycle ($g/m^2$) | T Value |
|---|---|---|---|---|---|---|
| | Yield Strength (MPa) | Tensile Strength (MPa) | Elongation Ratio (%) | Plastic Anisotropic Index ($r_m$) | | |
| Test Example 43 | 289 | 374 | 37 | 1.43 | 804 | 30.95 |
| Test Example 44 | 187 | 284 | 47 | 1.89 | 1093 | 53.146 |

As can be noted from Table 9, in Test Examples 41 through 44 according to the fourth embodiment of the present invention, a thickness reduction rate due to the corrosion is less than 545 $g/m^2$.

On the contrary, in Comparative Examples 41 through 43, it can be noted that a thickness reduction rate due to the corrosion is greater than 800 $g/m^2$. Particularly, in case of Comparative Example 44 where the titanium is added, the thickness reduction rate due to the corrosion is 1000 $g/m^2$.

In case of Comparative Examples 41 and 42, since the Cu or Co is independently added and thus it cannot function to improve the corrosion resistance, the thickness reduction rate due to the corrosion is very high. However, in case of Comparative examples 41 and 42, the corrosion resistance against the condensed water is better than that of the comparative example 44 where the titanium is added.

Meanwhile, in case of Comparative Example 43, since the carbon contents is out of the composition range of the fourth embodiment, the thickness reduction rate is 804 $g/m^2$ higher than those of Test Examples and the elongation ratio is 37% lower than those of Test Examples.

As can be noted from the above tests, Test Examples of the fourth embodiment have lower corrosion thickness reduction rates as compared with Comparative examples. That is, it can be noted that the steel sheet according to the fourth embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Fifth Embodiment

In the fifth embodiment, the slabs were produced to have the chemical composition as in Table 10.

TABLE 10

| No. | Chemical Components (% by weight) | | | | | | | | | | | |
|---|---|---|---|---|---|---|---|---|---|---|---|---|
| | C | Si | Mn | P | S | Al | N | Cu | Co | Ni | Mo | Ti |
| Test Example 51 | 0.0014 | 0.22 | 0.328 | 0.01 | 0.008 | 0.03 | 0.002 | 0.26 | 0.035 | 0.38 | 0.11 | 0 |
| Test Example 52 | 0.0022 | 0.27 | 0.38 | 0.009 | 0.009 | 0.022 | 0.0015 | 0.35 | 0.027 | 0.31 | 0.18 | 0 |
| Test Example 53 | 0.0023 | 0.15 | 0.32 | 0.011 | 0.01 | 0.031 | 0.0032 | 0.44 | 0.017 | 0.24 | 0.15 | 0 |
| Test Example 54 | 0.0012 | 0.15 | 0.44 | 0.012 | 0.009 | 0.033 | 0.0028 | 0.56 | 0.022 | 0.33 | 0.09 | 0 |
| Comparative Example 51 | 0.0032 | 0.04 | 0.07 | 0.009 | 0.011 | 0.032 | 0.0032 | 0 | 0 | 0.29 | 0 | 0 |
| Comparative Example 52 | 0.0018 | 0.11 | 0.12 | 0.012 | 0.007 | 0.019 | 0.0027 | 0.33 | 0 | 0 | 0 | 0 |
| Comparative Example 53 | 0.019 | 0.17 | 0.3 | 0.01 | 0.011 | 0.036 | 0.0017 | 0 | 0.019 | 0.32 | 0.11 | 0 |
| Comparative Example 54 | 0.0018 | 0.03 | 0.25 | 0.013 | 0.008 | 0.033 | 0.0028 | 0 | 0 | 0 | 0 | 0.04 |

A process for producing the heat-rolled steel sheet, a process for annealing the heat-rolled steel sheet, and a method for evaluating the physical properties of this fifth embodiment are same as those of the first embodiment.

The evaluation result of the mechanical properties and corrosion resistance against the condensed water, which are measured according to the fifth embodiment, and the value T representing the process ability of each sample are illustrated in Table 11.

TABLE 11

| No. | Mechanical Properties | | | | Thickness Reduction due to Corrosion after 10 Cycle ($g/m^2$) | T Value |
|---|---|---|---|---|---|---|
| | Yield Strength (MPa) | Tensile Strength (MPa) | Elongation Ratio (%) | Plastic Anisotropic Index ($r_m$) | | |
| Test Example 51 | 259 | 367 | 40 | 1.31 | 544 | 40.898 |
| Test Example 52 | 255 | 360 | 42 | 1.34 | 536 | 37.624 |
| Test Example 53 | 265 | 369 | 41 | 1.39 | 530 | 40.506 |
| Test Example 54 | 260 | 377 | 40 | 1.32 | 529 | 37.054 |
| Comparative Example 51 | 212 | 319 | 46 | 1.56 | 919 | 52.604 |
| Comparative Example 52 | 248 | 360 | 42 | 1.44 | 824 | 50.586 |
| Comparative Example 53 | 260 | 379 | 37 | 1.47 | 774 | 32.36 |
| Comparative Example 54 | 197 | 284 | 47 | 1.89 | 1093 | 53.146 |

As can be noted from Table 11, in Test Examples 51 through 54 according to the fourth embodiment of the present invention, a thickness reduction rate due to the corrosion is less than 544 $g/m^2$.

On the contrary, in Comparative Examples 51 through 53, it can be noted that a thickness reduction rate due to the corrosion is greater than 770 $g/m^2$. Particularly, in case of Comparative Example 54 where the titanium is added, the thickness reduction rate due to the corrosion is 1000 $g/m^2$.

In case of Comparative Examples 51 and 52, since the Cu or Co is independently added and thus it cannot function to improve the corrosion resistance, the thickness reduction rate due to the corrosion is very high. However, in case of Comparative examples 51 and 52, the corrosion resistance against the condensed water is better than that of the comparative example 54 where the titanium is added.

Meanwhile, in case of Comparative Example 53, since the carbon contents is out of the composition range of the fifth embodiment, the thickness reduction rate is 774 $g/m^2$ higher than those of Test Examples and the elongation ratio is 37% lower than those of Test Examples.

As can be noted from the above tests, Test Examples of the fifth embodiment have lower corrosion thickness reduction rates as compared with Comparative examples. That is, it can be noted that the steel sheet according to the fifth embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Sixth Embodiment

In the sixth embodiment, the slabs were produced to have the chemical composition as in Table 12.

TABLE 12

| No. | Chemical Components (% by weight) | | | | | | | | | | | |
|---|---|---|---|---|---|---|---|---|---|---|---|---|
| | C | Si | Mn | P | S | Al | N | Cu | Co | Ni | Cr | Ti |
| Test Example 61 | 0.0031 | 0.15 | 0.48 | 0.009 | 0.008 | 0.023 | 0.0015 | 0.29 | 0.019 | 0.22 | 0.12 | 0 |
| Test Example 62 | 0.0023 | 0.2 | 0.32 | 0.009 | 0.009 | 0.03 | 0.0019 | 0.35 | 0.0224 | 0.26 | 0.2 | 0 |
| Test Example 63 | 0.0035 | 0.24 | 0.35 | 0.011 | 0.01 | 0.033 | 0.0023 | 0.39 | 0.035 | 0.32 | 0.25 | 0 |
| Test Example 64 | 0.0019 | 0.14 | 0.31 | 0.009 | 0.012 | 0.035 | 0.003 | 0.53 | 0.024 | 0.38 | 0.18 | 0 |
| Comparative Example 61 | 0.0023 | 0.12 | 0.09 | 0.012 | 0.011 | 0.029 | 0.0017 | 0 | 0 | 0.33 | 0 | 0 |
| Comparative Example 62 | 0.0032 | 0.08 | 0.12 | 0.011 | 0.012 | 0.035 | 0.0032 | 0.25 | 0 | 0 | 0.2 | 0 |
| Comparative Example 63 | 0.018 | 0.22 | 0.33 | 0.012 | 0.01 | 0.036 | 0.0033 | 0 | 0.043 | 0.29 | 0.15 | 0 |
| Comparative Example 64 | 0.0018 | 0.03 | 0.25 | 0.013 | 0.008 | 0.033 | 0.0028 | 0 | 0 | 0 | 0 | 0.04 |

A process for producing the heat-rolled steel sheet, a process for annealing the heat-rolled steel sheet, and a method for evaluating the physical properties of this sixth embodiment are same as those of the first embodiment.

The evaluation result of the mechanical properties and corrosion resistance against the condensed water, which are measured according to the sixth embodiment, and the value T representing the process ability of each sample are illustrated in Table 13.

TABLE 13

| No. | Mechanical Properties: Yield Strength (MPa) | Tensile Strength (MPa) | Elongation Ratio (%) | Plastic Anisotropic Index ($r_m$) | Thickness: Reduction due to Corrosion after 10-Cycle (g/m$^2$) | T TValue |
|---|---|---|---|---|---|---|
| Test Example61 | 269 | 355 | 42 | 1.45 | 510 | 38.902 |
| Test Example 62 | 259 | 359 | 40 | 1.34 | 515 | 40.182 |
| Test Example 63 | 259 | 364 | 40 | 1.39 | 503 | 36.44 |
| Test Example 64 | 255 | 360 | 39 | 1.41 | 486 | 38.378 |
| Comparative Example 61 | 204 | 321 | 45 | 1.54 | 912 | 51.306 |
| Comparative Example 62 | 238 | 355 | 42 | 1.31 | 783 | 49.304 |
| Comparative Example 63 | 289 | 374 | 37 | 1.13 | 824 | 31.53 |
| Comparative Example 64 | 187 | 284 | 47 | 1.89 | 1093 | 53.146 |

As can be noted from Table 13, in Test Examples 61 through 64 according to this sixth embodiment of the present invention, a thickness reduction rate due to the corrosion is less than 503/m$^2$.

On the contrary, in Comparative Examples 61 through 63, it can be, noted that a thickness reduction rate due to the corrosion is greater than 780 g/m$^2$. Particularly, in case of Comparative Example 64 where the titanium is added, the thickness reduction rate due to the corrosion is 1000 g/m$^2$.

In case of Comparative Examples 61 and 62, since the Cu or Co is independently added and thus it cannot function to improve the corrosion resistance, the thickness reduction rate due to the corrosion is very high. However, in case of Comparative examples 61 and 62, the corrosion resistance against the condensed water is better than that of the comparative example 64 where the titanium is added.

Meanwhile, in case of Comparative Example 63, since the carbon contents is out of the composition range of the sixth embodiment, the thickness reduction rate is 824 g/m$^2$ higher than those of Test Examples and the elongation ratio is 37% lower than those of Test Examples.

As can be noted from the above tests, Test Examples of the sixth embodiment have lower corrosion thickness reduction rates as compared with Comparative examples. That is, it can be noted that the steel sheet according to the sixth embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Seventh Embodiment

In the seventh embodiment, the slabs were produced to have the chemical composition as in Table 14.

TABLE 14

| No. | Chemical Components (% by weight): C | Si | Mn | P | S | Al | N | Cu | Co | Mo | Cr | Ti |
|---|---|---|---|---|---|---|---|---|---|---|---|---|
| Test Example 71 | 0.0032 | 0.22 | 0.32 | 0.009 | 0.009 | 0.03 | 0.0012 | 0.25 | 0.032 | 0.06 | 0.28 | 0 |
| Test Example 72 | 0.0022 | 0.15 | 0.42 | 0.011 | 0.013 | 0.023 | 0.0023 | 0.34 | 0.014 | 0.12 | 0.21 | 0 |
| Test Example 73 | 0.0018 | 0.26 | 0.32 | 0.008 | 0.011 | 0.043 | 0.0029 | 0.55 | 0.025 | 0.15 | 0.15 | 0 |
| Test Example 74 | 0.0023 | 0.27 | 0.33 | 0.012 | 0.012 | 0.024 | 0.004 | 0.22 | 0.033 | 0.18 | 0.22 | 0 |
| Comparative Example 71 | 0.0026 | 0.05 | 0.08 | 0.009 | 0.012 | 0.053 | 0.0022 | 0.28 | 0 | 0 | 0 | 0 |
| Comparative Example 72 | 0.0032 | 0.32 | 0.33 | 0.012 | 0.008 | 0.029 | 0.0032 | 0 | 0.035 | 0 | 0.13 | 0 |
| Comparative Example 73 | 0.023 | 0.22 | 0.32 | 0.013 | 0.010 | 0.03 | 0.0021 | 0.32 | 0 | 0.15 | 0 | 0 |
| Comparative Example 74 | 0.0018 | 0.03 | 0.25 | 0.013 | 0.008 | 0.033 | 0.0028 | 0 | 0 | 0 | 0 | 0.04 |

A process for producing the heat-rolled steel sheet, a process for annealing the heat-rolled steel sheet, and a method for The evaluation result of the mechanical properties and corrosion resistance against the condensed water, which are measured according to the seventh embodiment, and the value T representing the process ability of each sample are illustrated in Table 15.

TABLE 15

| | Mechanical Properties | | | | Thickness | |
|---|---|---|---|---|---|---|
| No. | Yield Strength (MPa) | Tensile Strength (MPa) | Elongation Ratio (%) | Plastic Anisotropic Index ($r_m$) | Reduction rate due to Corrosion after 10 Cycle (g/m$^2$) | T Value |
| Test Example 71 | 260 | 366 | 40 | 1.31 | 500 | 41.764 |
| Test Example 72 | 254 | 369 | 40 | 1.33 | 496 | 40.774 |
| Test Example 73 | 260 | 364 | 40 | 1.39 | 487 | 39.046 |
| Test Example 74 | 255 | 350 | 39 | 1.28 | 495 | 41.386 |
| Comparative Example 71 | 219 | 322 | 46 | 1.59 | 805 | 52.262 |
| Comparative Example 72 | 238 | 350 | 42 | 1.31 | 856 | 44.714 |
| Comparative Example 73 | 255 | 375 | 36 | 1.21 | 769 | 27.32 |
| Comparative Example 74 | 187 | 284 | 47 | 1.89 | 1093 | 53.146 |

As can be noted from Table 15, in Test Examples 71 through 74 according to this seventh embodiment of the present invention, a thickness reduction rate due to the corrosion is less than 500/m$^2$.

On the contrary, in Comparative Examples 71 through 73, it can be noted that a thickness reduction rate due to the corrosion is greater than 769 μm$^2$. Particularly, in case of Comparative Example 74 where the titanium is added, the thickness reduction rate due to the corrosion is 1000 g/m$^2$.

In case of Comparative Examples 71 and 72, since the Cu or Co is independently added and thus it cannot function to improve the corrosion resistance, the thickness reduction rate due to the corrosion is very high. However, in case of Comparative examples 71 and 72, the corrosion resistance against the condensed water is better than that of the comparative example 74 where the titanium is added.

Meanwhile, in case of Comparative Example 73, since the carbon contents is out of the composition range of the seventh embodiment, the thickness reduction rate is 769 g/m$^2$ higher than those of Test Examples and the elongation ratio is 36% lower than those of Test Examples.

As can be noted from the above tests, Test Examples of the seventh embodiment have lower corrosion thickness reduction rates as compared with Comparative examples. That is, it can be noted that the steel sheet according to the seventh embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Eighth Embodiment

In the eighth embodiment, the slabs were produced to have the chemical composition as in Table 16.

TABLE 16

| | Chemical Components (% by weight) | | | | | | | | | | | | |
|---|---|---|---|---|---|---|---|---|---|---|---|---|---|
| No. | C | Si | Mn | P | S | Al | N | Cu | Co | Ni | Mo | Cr | Ti |
| Test Example 81 | 0.004 | 0.15 | 0.38 | 0.008 | 0.01 | 0.033 | 0.0025 | 0.29 | 0.032 | 0.32 | 0.08 | 0.19 | 0 |
| Test Example 82 | 0.0018 | 0.25 | 0.32 | 0.012 | 0.012 | 0.025 | 0.0015 | 0.33 | 0.014 | 0.37 | 0.11 | 0.23 | 0 |
| Test Example 83 | 0.0032 | 0.25 | 0.35 | 0.01 | 0.012 | 0.041 | 0.002 | 0.41 | 0.03 | 0.22 | 0.18 | 0.18 | 0 |
| Test Example 84 | 0.0022 | 0.18 | 0.32 | 0.01 | 0.008 | 0.022 | 0.0013 | 0.52 | 0.024 | 0.3 | 0.1 | 0.29 | 0 |
| Comparative Example 81 | 0.0029 | 0.14 | 0.09 | 0.013 | 0.009 | 0.022 | 0.0016 | 0 | 0 | 0.35 | 0 | 0 | 0 |
| Comparative Example 2 | 0.0052 | 0.04 | 0.12 | 0.008 | 0.01 | 0.025 | 0.0022 | 0.35 | 0 | 0 | 0 | 0.23 | 0 |
| Comparative Example 83 | 0.015 | 0.24 | 0.33 | 0.011 | 0.01 | 0.031 | 0.0023 | 0 | 0.022 | 0.24 | 0.1 | 0.25 | 0 |
| Comparative Example 84 | 0.0018 | 0.03 | 0.25 | 0.013 | 0.008 | 0.033 | 0.0028 | 0 | 0 | 0 | 0 | 0 | 0.04 |

A process for producing the heat-rolled steel sheet, a process for annealing the heat-rolled steel sheet, and a method for evaluating the physical properties of this eighth embodiment are same as those of the first embodiment.

The evaluation result of the mechanical properties and corrosion resistance against the condensed water, which are measured according to the eighth embodiment, and the value T representing the process ability of each sample are illustrated in Table 17.

TABLE 17

| No. | Mechanical Properties | | | | Thickness Reduction Rate | T Value |
|---|---|---|---|---|---|---|
| | Yield Strength (MPa) | Tensile Strength (MPa) | Elongation Ratio (%) | Plastic Anisotropic Index ($r_m$) | Due to Corrosion after 10 Cycle ($g/m^2$) | |
| Test Example 81 | 268 | 375 | 39 | 1.25 | 473 | 37.87 |
| Test Example 82 | 259 | 369 | 40 | 1.24 | 466 | 37.926 |
| Test Example 83 | 265 | 384 | 41 | 1.31 | 459 | 36.454 |
| Test Example 84 | 265 | 383 | 39 | 1.21 | 447 | 36.584 |
| Test Example 81 | 204 | 321 | 45 | 1.54 | 932 | 50.338 |
| Test Example 82 | 238 | 365 | 41 | 1.39 | 790 | 46.904 |
| Test Example 83 | 279 | 385 | 36 | 1.43 | 724 | 32.68 |
| Test Example 84 | 187 | 284 | 47 | 1.89 | 1093 | 53.146 |

As can be noted from Table 17, in Test Examples 81 through 84 according to this eighth embodiment of the present invention, a thickness reduction rate due to the corrosion is less than $473/m^2$.

On the contrary, in Comparative Examples 81 through 83, it can be noted that a thickness reduction rate due to the corrosion is greater than 724 $g/m^2$. Particularly, in case of Comparative Example 84 where the titanium is added, the thickness reduction rate due to the corrosion is 1000 $g/m^2$.

In case of Comparative Examples 81 and 82, since the Cu or Co is independently added and thus it cannot function to improve the corrosion resistance, the thickness reduction rate due to the corrosion is very high. However, in case of Comparative examples 81 and 82, the corrosion resistance against the condensed water is better than that of the comparative example 84 where the titanium is added.

Meanwhile, in case of Comparative Example 83, since the carbon contents is out of the composition range of the eighth embodiment, the thickness reduction rate is 724 $g/m^2$ higher than those of Test Examples and the elongation ratio is 36% lower than those of Test Examples.

As can be noted from the above tests, Test Examples of the eighth embodiment have lower corrosion thickness reduction rates as compared with Comparative examples. That is, it can be noted that the steel sheet according to the eighth embodiment is excellent in corrosion resistance.

Regarding the mechanical properties, it can also be noted that those of Test Examples are better than those of Comparative Examples.

Regarding the value T representing the process ability, the present examples has 35 or more T value. This shows that the steel sheets of the present examples have softness almost similar to those of the comparative examples.

Ninth Embodiment

In the ninth embodiment, the slabs were produced to have the chemical composition as in Table 18.

TABLE 18

| No. | Chemical Components (% by weight) | | | | | | | | | | | |
|---|---|---|---|---|---|---|---|---|---|---|---|---|
| | C | Si | Mn | P | S | Al | N | Cu | Co | Ti | Nb | Nb/C |
| Test Example 91 | 0.0018 | 0.17 | 0.35 | 0.011 | 0.009 | 0.034 | 0.0023 | 0.25 | 0.015 | 0 | 0.018 | 1.29 |
| Test Example 92 | 0.0034 | 0.21 | 0.43 | 0.01 | 0.011 | 0.023 | 0.002 | 0.35 | 0.012 | 0 | 0.02 | 0.759 |
| Test Example 93 | 0.0022 | 0.24 | 0.32 | 0.012 | 0.01 | 0.04 | 0.0013 | 0.54 | 0.032 | 0 | 0.03 | 1.76 |
| Comparative Example 91 | 0.023 | 0.12 | 0.32 | 0.008 | 0.008 | 0.032 | 0.0022 | 0.32 | 0.022 | 0 | 0 | 0 |
| Test Example 92 | 0.0022 | 0.03 | 0.05 | 0.008 | 0.01 | 0.032 | 0.0015 | 0.28 | 0 | 0 | 0.02 | 1.173 |

TABLE 18-continued

| No. | Chemical Components (% by weight) | | | | | | | | | | | |
|---|---|---|---|---|---|---|---|---|---|---|---|---|
| | C | Si | Mn | P | S | Al | N | Cu | Co | Ti | Nb | Nb/C |
| Test Example 93 | 0.0028 | 0.2 | 0.21 | 0.01 | 0.009 | 0.035 | 0.002 | 0 | 0.02 | 0 | 0.072 | 3.318 |
| Test Example 94 | 0.0018 | 0.03 | 0.25 | 0.013 | 0.008 | 0.033 | 0.0028 | 0 | 0 | 0.04 | 0 | 0 |

A process for producing the heat-rolled steel sheet, a process for annealing the heat-rolled steel sheet, and a method for evaluating the physical properties of this ninth embodiment are same as those of the first embodiment.

The evaluation result of the mechanical properties and corrosion resistance against the condensed water, which are measured according to the ninth embodiment, and the value T representing the process ability of each sample are illustrated in Table 19.

Meanwhile, in case of Comparative Example 91, since the carbon content is within the composition range of the ninth embodiment, the thickness reduction rate is 654 g/m$^2$ that is relatively low. However, since the carbon content is high and no Nb is added, the plastic anisotropic index is 1.41 that is very low and the elongation ratio is 35% lower than those of Test Examples. Therefore, the drawability and elongation process ability are very inferior.

TABLE 19

| No | Mechanical Properties | | | | Thickness | |
|---|---|---|---|---|---|---|
| | Yield Strength (MPa) | Tensile Strength (MPa) | Elongation Ratio (%) | Plastic Anisotropic Index ($r_m$) | Reduction Rate due to Corrosion after 10 Cycle (g/m$^2$) | T Value |
| Test Example 91 | 215 | 348 | 44 | 2.05 | 635 | 45.896 |
| Test Example 92 | 221 | 354 | 43 | 1.89 | 618 | 41.278 |
| Test Example 93 | 228 | 361 | 41 | 1.98 | 609 | 41.484 |
| Comparative Example 91 | 263 | 372 | 35 | 1.41 | 654 | 29.8 |
| Comparative Example 92 | 212 | 318 | 46 | 2.12 | 863 | 53.474 |
| Comparative Example 93 | 229 | 346 | 41 | 1.64 | 903 | 50.416 |
| Comparative Example 94 | 187 | 284 | 47 | 1.89 | 1093 | 53.146 |

As can be noted from Table 19, in Test Examples 91 through 93 according to this ninth embodiment of the present invention, a thickness reduction rate due to the corrosion is less than 635/m$^2$.

On the contrary, in Comparative Examples 92 and 93, it can be noted that a thickness reduction rate due to the corrosion is greater than 850 g/m$^2$. Particularly, in case of Comparative Example 94 where the titanium is added, the thickness reduction rate due to the corrosion is 1000 g/m$^2$.

In case of Comparative Examples 92 and 93, since the Cu or Co is independently added and thus it cannot function to improve the corrosion resistance, the thickness reduction rate due to the corrosion is very high. However, in case of Comparative examples 92 and 93, the corrosion resistance against the condensed water is better than that of the comparative example 94 where the titanium is added.

As can be noted from the above tests, Test Examples of the ninth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are better than those of Comparative Examples.

Tenth Embodiment

In the tenth embodiment, the slabs were produced to have the chemical composition as in Table 20.

TABLE 20

| No. | Chemical Components (% by weight) | | | | | | | | | | | | |
|---|---|---|---|---|---|---|---|---|---|---|---|---|---|
| | C | Si | Mn | P | S | Al | N | Cu | Co | Ti | Ni | Nb | Nb/C |
| Test Example 101 | 0.0022 | 0.19 | 0.48 | 0.01 | 0.011 | 0.034 | 0.0028 | 0.26 | 0.034 | 0 | 0.26 | 0.026 | 1.525 |

TABLE 20-continued

| No. | Chemical Components (% by weight) | | | | | | | | | | | | |
|---|---|---|---|---|---|---|---|---|---|---|---|---|---|
| | C | Si | Mn | P | S | Al | N | Cu | Co | Ti | Ni | Nb | Nb/C |
| Test Example 102 | 0.0035 | 0.25 | 0.35 | 0.012 | 0.009 | 0.033 | 0.0022 | 0.42 | 0.028 | 0 | 0.34 | 0.019 | 0.7 |
| Test Example 103 | 0.0012 | 0.27 | 0.37 | 0.009 | 0.01 | 0.025 | 0.0025 | 0.35 | 0.038 | 0 | 0.35 | 0.006 | 0.645 |
| Comparative Example101 | 0.022 | 0.13 | 0.33 | 0.011 | 0.009 | 0.036 | 0.0016 | 0.53 | 0.018 | 0 | 0.26 | 0 | 0 |
| Comparative Example 102 | 0.0015 | 0.21 | 0.18 | 0.009 | 0.011 | 0.039 | 0.0029 | 0 | 0.023 | 0 | 0.38 | 0.015 | 1.29 |
| Comparative Example 103 | 0.0035 | 0.07 | 0.18 | 0.011 | 0.008 | 0.025 | 0.0032 | 0.27 | 0 | 0 | 0 | 0.066 | 2.433 |
| Comparative Example 104 | 0.0018 | 0.03 | 0.25 | 0.013 | 0.008 | 0.033 | 0.0028 | 0 | 0 | 0.04 | 0 | 0 | 0 |

A process for producing the heat-rolled steel sheet, a process for annealing the heat-rolled steel sheet, and a method for evaluating the physical properties of this tenth embodiment are same as those of the first embodiment.

The evaluation result of the mechanical properties and corrosion resistance against the condensed water, which are measured according to the tenth embodiment, and the value T representing the process ability of each sample are illustrated in Table 21.

Meanwhile, in case of Comparative Example 101, since the carbon content is within the composition range of the tenth embodiment, the thickness reduction rate is 612 g/m$^2$ that is relatively good. However, since the carbon content is high and no Nb is added, the plastic anisotropic index is 1.39 that is very low and the elongation ratio is 35% lower than those of Test Examples. Therefore, the drawability and elongation process ability are very inferior.

TABLE 21

| No. | Mechanical Properties | | | | Thickness Reduction | |
|---|---|---|---|---|---|---|
| | Yield Strength (MPa) | Tensile Strength (MPa) | Elongation Ratio (%) | Plastic Anisotropic Index ($r_m$) | Rate due to Corrosion after 10 Cycle (g/m$^2$) | T Value |
| Test Example 101 | 239 | 354 | 42 | 2.04 | 627 | 39.774 |
| Test Example 102 | 229 | 359 | 41 | 1.97 | 631 | 37.8 |
| Test Example 103 | 231 | 363 | 43 | 1.84 | 609 | 39.534 |
| Comparative Example 101 | 266 | 372 | 35 | 1.39 | 612 | 25.15 |
| Comparative Example 102 | 208 | 327 | 46 | 2.08 | 922 | 48.05 |
| Comparative Example 103 | 241 | 359 | 39 | 1.64 | 902 | 49.38 |
| Comparative Example 104 | 187 | 284 | 47 | 1.89 | 1093 | 53.146 |

As can be noted from Table 21, in Test Examples 101 through 103 according to this tenth embodiment of the present invention, a thickness reduction rate due to the corrosion is less than 631/m$^2$.

On the contrary, in Comparative Examples 102 and 103, it can be noted that a thickness reduction rate due to the corrosion is greater than 900 μm$^2$. Particularly, in case of Comparative Example 104 where the titanium is added, the thickness reduction rate due to the corrosion is 1000 g/m$^2$.

In case of Comparative Examples 102 and 103, since the Cu or Co is independently added and thus it cannot function to improve the corrosion resistance, the thickness reduction rate due to the corrosion is very high. However, in case of Comparative examples 102 and 103, the corrosion resistance against the condensed water is better than that of the comparative example 104 where the titanium is added.

As can be noted from the above tests, Test Examples of the tenth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are better than those of Comparative Examples.

Eleventh Embodiment

In the eleventh embodiment, the slabs were produced to have the chemical composition as in Table 22.

TABLE 22

| No. | Chemical Components (% by weight) | | | | | | | | | | | | |
|---|---|---|---|---|---|---|---|---|---|---|---|---|---|
| | C | Si | Mn | P | S | Al | N | Cu | Co | Ti | Mo | Nb | Nb/C |
| Test Example 111 | 0.0018 | 0.24 | 0.37 | 0.011 | 0.008 | 0.025 | 0.0028 | 0.33 | 0.017 | 0 | 0.08 | 0.025 | 1.792 |
| Test Example 112 | 0.0032 | 0.13 | 0.44 | 0.009 | 0.011 | 0.038 | 0.0024 | 0.42 | 0.025 | 0 | 0.14 | 0.015 | 0.605 |
| Test Example 113 | 0.0025 | 0.26 | 0.36 | 0.012 | 0.008 | 0.022 | 0.0019 | 0.54 | 0.023 | 0 | 0.08 | 0.022 | 1.135 |
| Comparative Example 111 | 0.018 | 0.23 | 0.35 | 0.008 | 0.012 | 0.038 | 0.0024 | 0.28 | 0.032 | 0 | 0.16 | 0 | 0 |
| Comparative Example 112 | 0.0019 | 0.06 | 0.12 | 0.011 | 0.008 | 0.041 | 0.0022 | 0.34 | 0 | 0 | 0 | 0.023 | 1.562 |
| Comparative Example 113 | 0.0034 | 0.32 | 0.34 | 0.009 | 0.011 | 0.035 | 0.0023 | 0 | 0.033 | 0 | 0 | 0.082 | 3.112 |
| Comparative Example 114 | 0.0018 | 0.03 | 0.25 | 0.013 | 0.008 | 0.033 | 0.0028 | 0 | 0 | 0.04 | 0 | 0 | 0 |

A process for producing the heat-rolled steel sheet, a process for annealing the heat-rolled steel sheet, and a method for evaluating the physical properties of this eleventh embodiment are same as those of the first embodiment.

The evaluation result of the mechanical properties and corrosion resistance against the condensed water, which are measured according to the eleventh embodiment, and the value T representing the process ability of each sample are illustrated in Table 23.

TABLE 23

| No. | Mechanical Properties | | | | Thickness Reduction Rate | |
|---|---|---|---|---|---|---|
| | Yield Strength (MPa) | Tensile Strength (MPa) | Elongation Ratio (%) | Plastic Anisotropic Index ($r_m$) | due to Corrosion after 10 Cycle ($g/m^2$) | T Value |
| Test Example 111 | 229 | 358 | 41 | 2.07 | 585 | 42.826 |
| Test Example 112 | 231 | 362 | 40 | 1.89 | 573 | 40.344 |
| Test Example 113 | 226 | 353 | 41 | 1.92 | 563 | 39.6 |
| Comparative Example 111 | 265 | 371 | 34 | 1.32 | 584 | 30.55 |
| Comparative Example 112 | 209 | 313 | 46 | 2.12 | 825 | 51.138 |
| Comparative Example 113 | 229 | 342 | 39 | 1.69 | 911 | 45.418 |
| Comparative Example 114 | 187 | 284 | 47 | 1.89 | 1093 | 53.146 |

As can be noted from Table 23, in Test Examples 111 through 113 according to this eleventh embodiment of the present invention, a thickness reduction rate due to the corrosion is less than $585/m^2$.

On the contrary, in Comparative Examples 112 and 113, it can be noted that a thickness reduction rate due to the corrosion is greater than 825 $g/m^2$. Particularly, in case of Comparative Example 114 where the titanium is added, the thickness reduction rate due to the corrosion is 1000 $g/m^2$.

In case of Comparative Examples 112 and 113, since the Cu or Co is independently added and thus it cannot function to improve the corrosion resistance, the thickness reduction rate due to the corrosion is very high. However, in case of Comparative examples 112 and 113, the corrosion resistance against the condensed water is better than that of the comparative example 114 where the titanium is added.

Meanwhile, in case of Comparative Example 111, since contents of components except for the carbon are within the composition range of the eleventh embodiment, the thickness reduction rate is 584 $g/m^2$ that is similar to the test examples. However, since the carbon content is out of the composition range of the eleventh embodiment and no Nb is added, the plastic anisotropic index is 1.32 that is very low and the elongation ratio is 35% due to the low T value. Therefore, the drawability and elongation process ability are very lower compared with the test example.

As can be noted from the above tests, Test Examples of the eleventh embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are better than those of Comparative Examples.

Twelfth Embodiment

In the twelfth embodiment, the slabs were produced to have the chemical composition as in Table 24.

TABLE 24

| | Chemical Components (% by weight) | | | | | | | | | | | | |
|---|---|---|---|---|---|---|---|---|---|---|---|---|---|
| No | C | Si | Mn | P | S | Al | N | Cu | Co | Ti | Cr | Nb | Nb/C |
| Test Example121 | 0.0025 | 0.24 | 0.31 | 0.011 | 0.012 | 0.035 | 0.0023 | 0.27 | 0.018 | 0 | 0.14 | 0.025 | 1.29 |
| Test Example 122 | 0.0034 | 0.19 | 0.38 | 0.01 | 0.01 | 0.04 | 0.0018 | 0.35 | 0.013 | 0 | 0.19 | 0.02 | 0.759 |
| Test Example 123 | 0.0015 | 0.24 | 0.45 | 0.01 | 0.008 | 0.033 | 0.0013 | 0.53 | 0.032 | 0 | 0.26 | 0.008 | 0.688 |
| Comparative Example 121 | 0.015 | 0.29 | 0.39 | 0.011 | 0.01 | 0.035 | 0.0022 | 0.47 | 0.032 | 0 | 0.27 | 0 | 0 |
| Comparative Example 122 | 0.002 | 0.03 | 0.08 | 0.009 | 0.012 | 0.036 | 0.0018 | 0.35 | 0 | 0 | 0 | 0.019 | 1.226 |
| Comparative Example 123 | 0.0032 | 0.22 | 0.29 | 0.012 | 0.008 | 0.035 | 0.0029 | 0 | 0.024 | 0 | 0.02 | 0.072 | 2.903 |
| Comparative Example 124 | 0.0018 | 0.03 | 0.25 | 0.013 | 0.008 | 0.033 | 0.0028 | 0 | 0 | 0.04 | 0 | 0 | 0 |

A process for producing the heat-rolled steel sheet, a process for annealing the heat-rolled steel sheet, and a method for evaluating the physical properties of this twelfth embodiment are same as those of the first embodiment.

The evaluation result of the mechanical properties and corrosion resistance against the condensed water, which are measured according to the twelfth embodiment, and the value T representing the process ability of each sample are illustrated in Table 25.

TABLE 25

| | Mechanical Properties | | | | Thickness Reduction | |
|---|---|---|---|---|---|---|
| No. | Yield Strength (MPa) | Tensile Strength (MPa) | Elongation Ratio (%) | Plastic Anisotropic Index ($r_m$) | Rate due to Corrosion after 10 Cycle (g/m$^2$) | T value |
| Test Example 121 | 225 | 358 | 42 | 2.08 | 545 | 43.71 |
| Test Example 122 | 229 | 362 | 41 | 1.92 | 521 | 41.048 |
| Test Example 123 | 235 | 371 | 41 | 1.82 | 511 | 37.47 |
| Comparative Example 121 | 266 | 375 | 34 | 1.42 | 551 | 28.03 |
| Comparative example 122 | 192 | 323 | 44 | 2.21 | 862 | 52.19 |
| Comparative Example 123 | 242 | 359 | 42 | 1.68 | 912 | 48.004 |
| Comparative Example 124 | 187 | 284 | 47 | 1.89 | 1093 | 53.146 |

As can be noted from Table 25, in Test Examples 121 through 123 according to this twelfth embodiment of the present invention, a thickness reduction rate due to the corrosion is less than 545/m$^2$.

On the contrary, in Comparative Examples 122 and 123, it can be noted that a thickness reduction rate due to the corrosion is greater than 850 g/m$^2$. Particularly, in case of Comparative Example 124 where the titanium is added, the thickness reduction rate due to the corrosion is 1000 g/m$^2$.

In case of Comparative Examples 122 and 123, since the Cu or Co is independently added and thus it cannot function to improve the corrosion resistance, the thickness reduction rate due to the corrosion is very high. However, in case of Comparative examples 122 and 123, the corrosion resistance against the condensed water is better than that of the comparative example 124 where the titanium is added.

Meanwhile, in case of Comparative Example 121, since contents of components except for the carbon are within the composition range of the twelfth embodiment, the thickness reduction rate is 551 g/m$^2$ that is similar to the test examples. However, since the carbon content is out of the composition range of the twelfth embodiment and no Nb is added, the plastic anisotropic index is 1.32 that is very low and the elongation ratio is 34% due to the low T value. Therefore, the drawability and elongation process ability are very lower compared with the test example.

As can be noted from the above tests, Test Examples of the twelfth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are equal to or better than those of Comparative Examples.

Thirteenth Embodiment

In the thirteenth embodiment, the slabs were produced to have the chemical composition as in Table 26.

TABLE 26

| | Chemical Components (% by weight) | | | | | | | | | | | | | |
|---|---|---|---|---|---|---|---|---|---|---|---|---|---|---|
| No. | C | Si | Mn | P | S | Al | N | Cu | Co | Ti | Ni | Mo | Nb | Nb/C |
| Test Example 131 | 0.002 | 0.21 | 0.32 | 0.008 | 0.011 | 0.032 | 0.0019 | 0.27 | 0.033 | 0 | 0.37 | 0.13 | 0.027 | 1.742 |
| Test Example 132 | 0.0014 | 0.28 | 0.37 | 0.01 | 0.008 | 0.025 | 0.0022 | 0.37 | 0.025 | 0 | 0.33 | 0.16 | 0.007 | 0.645 |
| Test Example 133 | 0.0029 | 0.13 | 0.36 | 0.009 | 0.012 | 0.033 | 0.0037 | 0.43 | 0.015 | 0 | 0.22 | 0.07 | 0.025 | 1.112 |
| Comparative Example 131 | 0.013 | 0.14 | 0.46 | 0.011 | 0.011 | 0.035 | 0.0024 | 0.54 | 0.021 | 0 | 0.31 | 0.09 | 0 | 0 |
| Comparative Example 132 | 0.0025 | 0.05 | 0.06 | 0.01 | 0.008 | 0.031 | 0.0029 | 0 | 0.022 | 0 | 0.27 | 0 | 0.022 | 1.135 |
| Comparative Example 133 | 0.0039 | 0.12 | 0.11 | 0.011 | 0.009 | 0.022 | 0.0024 | 0.32 | 0 | 0 | 0 | 0 | 0.085 | 2.812 |
| Comparative Example 134 | 0.0018 | 0.03 | 0.25 | 0.013 | 0.008 | 0.033 | 0.0028 | 0 | 0 | 0.04 | 0 | 0 | 0 | 0 |

A process for producing the heat-rolled steel sheet, a process for annealing the heat-rolled steel sheet, and a method for evaluating the physical properties of this thirteenth embodiment are same as those of the first embodiment.

The evaluation result of the mechanical properties and corrosion resistance against the condensed water, which are measured according to the thirteenth embodiment, and the value T representing the process ability of each sample are illustrated in Table 27.

TABLE 27

| | Mechanical Properties | | | | Thickness Reduction | |
|---|---|---|---|---|---|---|
| No. | Yield Strength (MPa) | Tensile Strength (MPa) | Elongation Ratio (%) | Plastic Anisotropic Index ($r_m$) | Rate due to Corrosion after 10 Cycle (g/m$^2$) | T |
| Test Example 131 | 221 | 359 | 41 | 2.12 | 545 | 40.58 |
| Test Example 132 | 215 | 358 | 42 | 1.88 | 533 | 38.038 |

TABLE 27-continued

| No. | Mechanical Properties | | | | Thickness Reduction | |
|---|---|---|---|---|---|---|
| | Yield Strength (MPa) | Tensile Strength (MPa) | Elongation Ratio (%) | Plastic Anisotropic Index ($r_m$) | Rate due to Corrosion after 10 Cycle (g/m$^2$) | T |
| Test Example 133 | 228 | 361 | 41 | 1.97 | 532 | 40.518 |
| Test Example 131 | 265 | 382 | 34 | 1.39 | 542 | 28.05 |
| Comparative Example 132 | 215 | 322 | 45 | 1.88 | 909 | 53.18 |
| Comparative Example 133 | 236 | 358 | 40 | 1.73 | 821 | 49.118 |
| Comparative Example 134 | 187 | 284 | 47 | 1.89 | 1093 | 53.146 |

As can be noted from Table 27, in Test Examples 131 through 133 according to this thirteenth embodiment of the present invention, a thickness reduction rate due to the corrosion is less than 545/m$^2$.

On the contrary, in Comparative Examples 132 and 133, it can be noted that a thickness reduction rate due to the corrosion is greater than 820 g/m$^2$. Particularly, in case of Comparative Example 134 where the titanium is added, the thickness reduction rate due to the corrosion is 1000 g/m$^2$.

In case of Comparative Examples 132 and 133, since the Cu or Co is independently added and thus it cannot function to improve the corrosion resistance, the thickness reduction rate due to the corrosion is very high. However, in case of Comparative examples 132 and 133, the corrosion resistance against the condensed water is better than that of the comparative example 134 where the titanium is added.

Meanwhile, in case of Comparative Example 131, since contents of components except for the carbon are within the composition range of the thirteenth embodiment, the thickness reduction rate is 542 g/m$^2$ that is similar to the test examples. However, since the carbon content is out of the composition range of the thirteenth embodiment and no Nb is added, the plastic anisotropic index is 1.39 that is very low and the elongation ratio is 34% due to the low T value. Therefore, the drawability and elongation process ability are very lower compared with the test example.

As can be noted from the above tests, Test Examples of the thirteenth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are equal to or better than those of Comparative Examples.

Fourteenth Embodiment

In the fourteenth embodiment, the slabs were produced to have the chemical composition as in Table 28.

TABLE 28

| No. | Chemical Components (% by weight) | | | | | | | | | | | | | |
|---|---|---|---|---|---|---|---|---|---|---|---|---|---|---|
| | C | Si | Mn | P | S | Al | N | Cu | Co | Ti | Ni | Cr | Nb | Nb/C |
| Test Example 141 | 0.0025 | 0.18 | 0.47 | 0.01 | 0.009 | 0.033 | 0.0027 | 0.27 | 0.016 | 0 | 0.24 | 0.15 | 0.031 | 1.6 |
| Test Example 142 | 0.0022 | 0.22 | 0.33 | 0.011 | 0.008 | 0.028 | 0.0016 | 0.36 | 0.024 | 0 | 0.28 | 0.22 | 0.015 | 0.88 |
| Test Example 143 | 0.0015 | 0.26 | 0.37 | 0.009 | 0.011 | 0.035 | 0.0023 | 0.42 | 0.032 | 0 | 0.32 | 0.23 | 0.008 | 0.69 |
| Comparative Example 141 | 0.033 | 0.14 | 0.34 | 0.01 | 0.012 | 0.037 | 0.0013 | 0.54 | 0.02 | 0 | 0.36 | 0.19 | 0 | 0 |
| Comparative Example 142 | 0.0025 | 0.15 | 0.11 | 0.012 | 0.008 | 0.025 | 0.0022 | 0 | 0.25 | 0 | 0.32 | 0 | 0.027 | 1.39 |
| Comparative Example 143 | 0.0032 | 0.08 | 0.11 | 0.009 | 0.01 | 0.032 | 0.0019 | 0.29 | 0 | 0 | 0 | 0.18 | 0.074 | 2.98 |
| Comparative Example 144 | 0.0018 | 0.03 | 0.25 | 0.013 | 0.008 | 0.033 | 0.0028 | 0 | 0 | 0.04 | 0 | 0 | 0 | 0 |

A process for producing the heat-rolled steel sheet, a process for annealing the heat-rolled steel sheet, and a method for evaluating the physical properties of this fourteenth embodiment are same as those of the first embodiment.

The evaluation result of the mechanical properties and corrosion resistance against the condensed water, which are measured according to the fourteenth embodiment, and the value T representing the process ability of each sample are illustrated in Table 29.

TABLE 29

| No. | Mechanical Properties | | | | Thickness Reduction Rate | T Value |
|---|---|---|---|---|---|---|
| | Yield Strength (MPa) | Tensile Strength (MPa) | Elongation Ratio (%) | Plastic Anisotropic Index ($r_m$) | due to Corrosion after 10 Cycle ($g/m^2$) | |
| Test Example 141 | 245 | 352 | 42 | 2.11 | 519 | 38.95 |
| Test Example 142 | 239 | 364 | 40 | 1.84 | 529 | 39.264 |
| Test Example 143 | 244 | 367 | 41 | 1.88 | 511 | 37.13 |
| Comparative Example 141 | 279 | 385 | 32 | 1.39 | 505 | 13.56 |
| Comparative Example 142 | 193 | 309 | 46 | 2.18 | 923 | 47.9 |
| Comparative Example 143 | 229 | 352 | 38 | 1.66 | 789 | 49.184 |
| Comparative Example 144 | 187 | 284 | 47 | 1.89 | 1093 | 53.146 |

As can be noted from Table 29, in Test Examples 141 through 143 according to this fourteenth embodiment of the present invention, a thickness reduction rate due to the corrosion is less than 529 $g/m^2$.

On the contrary, in Comparative Examples 142 and 143, it can be noted that a thickness reduction rate due to the corrosion is greater than 789 $g/m^2$. Particularly, in case of Comparative Example 144 where the titanium is added, the thickness reduction rate due to the corrosion is 1000 $g/m^2$.

In case of Comparative Examples 142 and 143, since the Cu or Co is independently added and thus it cannot function to improve the corrosion resistance, the thickness reduction rate due to the corrosion is very high. However, in case of Comparative examples 142 and 143, the corrosion resistance against the condensed water is better than that of the comparative example 144 where the titanium is added.

Meanwhile, in case of Comparative Example 141, since contents of components except for the carbon are within the composition range of the fourteenth embodiment, the thickness reduction rate is 505 $g/m^2$ that is similar to the test examples. However, since the carbon content is out of the composition range of the fourteenth embodiment and no Nb is added, the plastic anisotropic index is 1.39 that is very low and the elongation ratio is 34% due to the low T value. Therefore, the drawability and elongation process ability are very lower compared with the test example.

As can be noted from the above tests, Test Examples of the fourteenth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are equal to or better than those of Comparative Examples.

Fifteenth Embodiment

In the fifteenth embodiment, the slabs were produced to have the chemical composition as in Table 30.

TABLE 30

| No. | Chemical Components (% by weight) | | | | | | | | | | | | | |
|---|---|---|---|---|---|---|---|---|---|---|---|---|---|---|
| | C | Si | Mn | P | S | Al | N | Cu | Co | Ti | Mo | Cr | Nb | Nb/C |
| Test Example 151 | 0.0035 | 0.23 | 0.34 | 0.011 | 0.009 | 0.036 | 0.0022 | 0.27 | 0.03 | 0 | 0.08 | 0.26 | 0.028 | 1.032 |
| Test Example 152 | 0.0021 | 0.16 | 0.41 | 0.009 | 0.01 | 0.025 | 0.0019 | 0.36 | 0.013 | 0 | 0.13 | 0.24 | 0.017 | 1.045 |
| Test Example 153 | 0.0015 | 0.24 | 0.35 | 0.012 | 0.01 | 0.042 | 0.0022 | 0.56 | 0.026 | 0 | 0.12 | 0.13 | 0.007 | 0.602 |
| Comparative Example 151 | 0.021 | 0.23 | 0.38 | 0.009 | 0.009 | 0.0224 | 0.0013 | 0.25 | 0.035 | 0 | 0.18 | 0.26 | 0 | 0 |

TABLE 30-continued

| No. | Chemical Components (% by weight) | | | | | | | | | | | | | |
|---|---|---|---|---|---|---|---|---|---|---|---|---|---|---|
| | C | Si | Mn | P | S | Al | N | Cu | Co | Ti | Mo | Cr | Nb | Nb/C |
| Comparative Example 152 | 0.0021 | 0.05 | 0.07 | 0.011 | 0.012 | 0.041 | 0.0021 | 0.27 | 0 | 0 | 0 | 0 | 0.025 | 1.536 |
| Comparative Example 153 | 0.0026 | 0.38 | 0.31 | 0.013 | 0.012 | 0.024 | 0.0029 | 0 | 0.032 | 0 | 0 | 0.15 | 0.075 | 3.722 |
| Comparative Example 154 | 0.0018 | 0.03 | 0.25 | 0.013 | 0.008 | 0.033 | 0.0028 | 0 | 0 | 0.04 | 0 | 0 | 0 | 0 |

A process for producing the heat-rolled steel sheet, a process for annealing the heat-rolled steel sheet, and a method for evaluating the physical properties of this fifteenth embodiment are same as those of the first embodiment.

The evaluation result of the mechanical properties and corrosion resistance against the condensed water, which are measured according to the fifteenth embodiment, and the value T representing the process ability of each sample are illustrated in Table 31.

TABLE 31

| No. | Mechanical Properties | | | | Thickness Reduction Rate due to | |
|---|---|---|---|---|---|---|
| | Yield Strength (MPa) | Tensile Strength (MPa) | Elongation Ratio (%) | Plastic Anisotropic Index ($r_m$) | Corrosion after 10 Cycle ($g/m^2$) | T Value |
| Test Example 151 | 231 | 362 | 41 | 1.96 | 513 | 40.76 |
| Test Example 152 | 225 | 363 | 41 | 1.89 | 490 | 40.352 |
| Test Example 153 | 236 | 359 | 42 | 1.85 | 485 | 39.25 |
| Comparative Example 151 | 267 | 377 | 33 | 1.41 | 502 | 25.7 |
| Comparative Example 152 | 208 | 326 | 45 | 2.18 | 817 | 52.972 |
| Comparative Example 153 | 229 | 352 | 41 | 1.69 | 858 | 44.552 |
| Comparative Example 154 | 187 | 284 | 47 | 1.89 | 1093 | 53.146 |

As can be noted from Table 31, in Test Examples 151 through 153 according to this fifteenth embodiment of the present invention, a thickness reduction rate due to the corrosion is less than 513 $g/m^2$.

On the contrary, in Comparative Examples 152 and 153, it can be noted that a thickness reduction rate due to the corrosion is greater than 817 $g/m^2$. Particularly, in case of Comparative Example 154 where the titanium is added, the thickness reduction rate due to the corrosion is 1000 $g/m^2$.

In case of Comparative Examples 152 and 153, since the Cu or Co is independently added and thus it cannot function to improve the corrosion resistance, the thickness reduction rate due to the corrosion is very high. However, in case of Comparative examples 152 and 153, the corrosion resistance against the condensed water is better than that of the comparative example 154 where the titanium is added.

Meanwhile, in case of Comparative Example 151, since contents of components except for the carbon are within the composition range of the fifteenth embodiment, the thickness reduction rate is 502 $g/m^2$ that is similar to the test examples. However, since the carbon content is out of the composition range of the fifteenth embodiment and no Nb is added, the plastic anisotropic index is 1.41 that is very low and the elongation ratio is 33% due to the low T value. Therefore, the drawability and elongation process ability are very lower compared with the test example.

As can be noted from the above tests, Test Examples of the fifteenth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are equal to or better than those of Comparative Examples.

Sixteenth Embodiment

In the sixteenth embodiment, the slabs were produced to have the chemical composition as in Table 32.

TABLE 32

| No. | Chemical Components (% by weight) | | | | | | | | | | | | | | |
|---|---|---|---|---|---|---|---|---|---|---|---|---|---|---|---|
| | C | Si | Mn | P | S | Al | N | Cu | Co | Ti | Ni | Mo | Cr | Nb | Nb/C |
| Test Example 161 | 0.0023 | 0.13 | 0.37 | 0.011 | 0.008 | 0.032 | 0.0019 | 0.25 | 0.033 | 0 | 0.31 | 0.07 | 0.22 | 0.033 | 1.851 |
| Test Example 162 | 0.0012 | 0.24 | 0.35 | 0.009 | 0.01 | 0.022 | 0.0022 | 0.34 | 0.015 | 0 | 0.36 | 0.13 | 0.21 | 0.008 | 0.86 |
| Test Example 163 | 0.0034 | 0.27 | 0.34 | 0.008 | 0.011 | 0.032 | 0.0029 | 0.43 | 0.032 | 0 | 0.23 | 0.17 | 0.16 | 0.041 | 1.556 |
| Comparative Example 161 | 0.018 | 0.17 | 0.42 | 0.012 | 0.012 | 0.027 | 0.0032 | 0.51 | 0.022 | 0 | 0.32 | 0.12 | 0.27 | 0 | 0 |
| Comparative Example 162 | 0.0021 | 0.15 | 0.08 | 0.011 | 0.011 | 0.025 | 0.0023 | 0 | 0.019 | 0 | 0.36 | 0 | 0 | 0.024 | 1.475 |
| Comparative Example 163 | 0.0048 | 0.06 | 0.11 | 0.011 | 0.01 | 0.028 | 0.0032 | 0.34 | 0 | 0 | 0 | 0 | 0.25 | 0.088 | 2.366 |
| Comparative Example 164 | 0.0018 | 0.03 | 0.25 | 0.013 | 0.008 | 0.033 | 0.0028 | 0 | 0 | 0.04 | 0 | 0 | 0 | 0 | 0 |

A process for producing the heat-rolled steel sheet, a process for annealing the heat-rolled steel sheet, and a method for evaluating the physical properties of this sixteenth embodiment are same as those of the first embodiment.

The evaluation result of the mechanical properties and corrosion resistance against the condensed water, which are measured according to the sixteenth embodiment, and the value T representing the process ability of each sample are illustrated in Table 33.

TABLE 33

| No. | Mechanical Properties | | | | Thickness | |
|---|---|---|---|---|---|---|
| | Yield Strength (MPa) | Tensile Strength (MPa) | Elongation Ratio (%) | Plastic Anisotropic Index ($r_m$) | Reduction Rate due to Corrosion after 10 Cycle (g/m$^2$) | T Value |
| Test Example 161 | 232 | 367 | 39 | 1.97 | 473 | 40.106 |
| Test Example 162 | 228 | 363 | 40 | 1.88 | 465 | 37.914 |
| Test Example 163 | 233 | 378 | 38 | 1.92 | 468 | 36.078 |
| Comparative Example 161 | 268 | 388 | 33 | 1.35 | 479 | 22.35 |
| Comparative Example 162 | 185 | 313 | 46 | 2.01 | 955 | 50.722 |
| Comparative Example 163 | 219 | 379 | 38 | 1.77 | 802 | 47.076 |
| Comparative Example 164 | 187 | 284 | 47 | 1.89 | 1093 | 53.146 |

As can be noted from Table 31, in Test Examples 161 through 163 according to this sixteenth embodiment of the present invention, a thickness reduction rate due to the corrosion is less than 473 g/m$^2$.

On the contrary, in Comparative Examples 162 and 163, it can be noted that a thickness reduction rate due to the corrosion is greater than 802 g/m$^2$. Particularly, in case of Comparative Example 164 where the titanium is added, the thickness reduction rate due to the corrosion is 1000 g/m$^2$.

In case of Comparative Examples 162 and 163, since the Cu or Co is independently added and thus it cannot function to improve the corrosion resistance, the thickness reduction rate due to the corrosion is very high. However, in case of Comparative examples 162 and 163, the corrosion resistance against the condensed water is better than that of the comparative example 164 where the titanium is added.

Meanwhile, in case of Comparative Example 161, since contents of components except for the carbon are within the composition range of the sixteenth embodiment, the thickness reduction rate is 479 g/m$^2$ that is similar to the test examples. However, since the carbon content is out of the composition range of the sixteenth embodiment and no Nb is added, the plastic anisotropic index is 1.35 that is very low and the elongation ratio is 33% due to the low T value. Therefore, the drawability and elongation process ability are very lower compared with the test example.

As can be noted from the above tests, Test Examples of the sixteenth embodiment have lower corrosion thickness reduction rates as compared with Comparative examples. In addition, since the plastic anisotropic index and the elongation ratio are high, the process ability as well as the corrosion resistance is very superior.

In addition, regarding the mechanical properties, it can also be noted that those of Test Examples are equal to or better than those of Comparative Examples.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

For example, a corrosion resistance material such as an aluminum-based alloy may be coated on the inventive steel sheet.

As described above, in the steel sheet according to the present invention, the steel sheet for the automotive muffler can be produced without using Cr or Ni that is relatively expensive.

Therefore, the manufacturing cost of the steel sheet can be reduced while the effective corrosion resistance is still remained in the steel sheet. Furthermore, the steel sheet of the present invention is excellent in the process ability and desired strength.

Accordingly, the steel sheet for the automotive muffler according to the present invention has the above-described physical and chemical properties and ensures the long term service life of the automotive muffler.

What is claimed is:

1. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; and a remainder of Fe and unavoidable impurities, wherein 60−280*C(%)−15*Si(%)−20*Mn(%)−12*Cu(%)−10*Co(%)≧35.

2. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.2 to 0.4% by weight of Ni; and a remainder of Fe and unavoidable impurities, wherein 60−780*C(%)−15*Si(%)−20*Mn(%)−12*Cu(%)−10*Co(%)−10 Ni(%)≧35.

3. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.05 to 0.2% by weight of Mo; and a remainder of Fe and unavoidable impurities, wherein 60−780*C(%)−15*Si(%)−20*Mn(%)−12*Cu(%)−10*Co(%)−8*Mo(%)≧35.

4. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.1 to 0.3% by weight of Cr; and a remainder of Fe and unavoidable impurities, wherein 60−780*C(%)−15*Si(%)−20*Mn(%)−12*Cu(%)−10*Co(%)−8*Cr(%)≧35.

5. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.2 to 0.4% by weight of Ni; 0.05 to 0.2% by weight of Mo; and a remainder of Fe and unavoidable impurities, wherein 60−780*C(%)−15*Si(%)−20*Mn(%)−12*Cu(%)−10*Co(%)−10*Ni(%)−8*Mo(%)≧35.

6. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.2 to 0.4% by weight of Ni; 0.1 to 0.3% by weight of Cr; and a remainder of Fe and unavoidable impurities, wherein 60−780*C(%)−15*Si(%)−20*M (%)−12*Cu(%)−10*Co(%)−10*Ni(%)−8*Cr(%)≧35.

7. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.05 to 0.2% by weight of Mo; 0.1 to 0.3% by weight of Cr; and a remainder of Fe and unavoidable impurities, wherein 60−780*C(%)−15*Si(%)−20*Mn(%)−12*Cu(%)−10*Co(%)−8*Mo(%)−8*Cr(%)≧35.

8. A steel sheet for an automotive muffler, comprising:

0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; 0.2 to 0.4% by weight of Ni; 0.05 to 0.2% by weight of Mo; 0.1 to 0.3% by weight of Cr; and a remainder of Fe and unavoidable impurities, wherein 60−280*C(%)−15*Si(%)−20*Mn(%)−12*Cu(%)−10*Co(%)−10*Ni(%)−8*Mo(%)−8*Cr(%)≧35.

9. The steel sheet of claim 1, further comprising 0.005 to 0.05% by weight of Nb, wherein a value Nb/C, which is defined by "Nb/C=(Nb(%)/93)/(C(%)/12)," is 0.5 to 2.0.

10. The steel sheet of claim 2, further comprising 0.005 to 0.05% by weight of Nb, wherein a value Nb/C, which is defined by "Nb/C=(Nb(%)/93)/(C(%)/12)," is 0.5 to 2.0.

11. The steel sheet of claim 4, further comprising 0.005 to 0.05% by weight of Nb, wherein a value Nb/C, which is defined by "Nb/C=(Nb(%)/93)/(C(%)/12)," is 0.5 to 2.0.

12. The steel sheet of claim 5, further comprising 0.005 to 0.05% by weight of Nb, wherein a value Nb/C, which is defined by "Nb/C=(Nb(%)/93)/(C(%)/12)," is 0.5 to 2.0.

13. The steel sheet of claim 6, further comprising 0.005 to 0.05% by weight of Nb, wherein a value Nb/C, which is defined by "Nb/C=(Nb(%)/93)/(C(%)/12)," is 0.5 to 2.0.

14. The steel sheet of claim 7, further comprising 0.005 to 0.05% by weight of Nb, wherein a value Nb/C, which is defined by "Nb/C=(Nb(%)/93)/(C(%)/12)," is 0.5 to 2.0.

15. The steel sheet of claim 8, further comprising 0.005 to 0.05% by weight of Nb, wherein a value Nb/C, which is defined by "Nb/C=(Nb(%)/93)/(C(%)/12)," is 0.5 to 2.0.

16. A method of producing a steel sheet for an automotive muffler, comprising:

preparing a steel slab comprising 0.01% by weight or less of C; 0.1 to 0.3% by weight of Si; 0.3 to 0.5% by weight of Mn; 0.015% by weight or less of P; 0.015% or less by weight of S; 0.02 to 0.05% by weight of Al; 0.004% or less of N; 0.2 to 0.6% by weight of Cu; 0.01 to 0.04% by weight of Co; and a remainder of Fe and unavoidable impurities;

preparing a hot rolled steel sheet by re-heating the steel slab followed by hot-rolling the steel slab, wherein the finishing rolling temperature is an Ar3 transformation temperature or more;

preparing a cold rolled steel sheet by cold-rolling the hot rolled steel sheet with a cold reduction ratio of 50 to 90%; and performing a continuous annealing for the cold rolled steel sheet at a temperature of 500 to 900° C., wherein $60-280*C(\%)-15*Si(\%)-20*Mn(\%)-12*Cu(\%)-10*Co(\%) \geqq 35$.

17. The method of claim 16, wherein, in preparing the hot rolled steel sheet, the hot rolled steel sheet is coiled at a coiling temperature of 600° C. or more.

18. The method of claim 17, wherein, in performing the continuous annealing, the continuous annealing is performed for 10 seconds to 30 minutes.

19. The steel sheet of claim 3, further comprising 0.005 to 0.05% by weight of Nb, wherein a value of Nb/C, which is defined by "Nb/C=(Nb(%)/93/(C(%)/12)," is 0.5 to 2.0.

* * * * *